US007931115B2

(12) United States Patent
Silver

(10) Patent No.: US 7,931,115 B2
(45) Date of Patent: Apr. 26, 2011

(54) DIAPHRAGM SURROUNDING

(75) Inventor: Jason D. Silver, Framingham, MA (US)

(73) Assignee: Bose Corporation

( * ) Notice: Subject to any disclaimer, the term of this patent is extended or adjusted under 35 U.S.C. 154(b) by 0 days.

(21) Appl. No.: 12/365,748

(22) Filed: Feb. 4, 2009

(65) Prior Publication Data

US 2009/0139794 A1 Jun. 4, 2009

Related U.S. Application Data

(63) Continuation-in-part of application No. 11/756,119, filed on May 31, 2007.

(51) Int. Cl.

| | |
|---|---|
| ***G10K 13/00*** | (2006.01) |
| ***H04R 7/20*** | (2006.01) |
| *H04R 7/16* | (2006.01) |
| *H04R 7/18* | (2006.01) |

(52) U.S. Cl. ..... 181/171; 181/172

(58) Field of Classification Search ..... 181/171, 181/172, 166, 173, 174; 381/392, 386, 423, 381/429

See application file for complete search history.

(56) References Cited

U.S. PATENT DOCUMENTS

| | | | | | |
|---|---|---|---|---|---|
| 1,732,351 | A | * | 10/1929 | Borkman | 181/173 |
| 1,832,608 | A | * | 11/1931 | Abrahams | 181/171 |
| 2,302,178 | A | * | 11/1942 | Brennan | 181/169 |
| 2,439,665 | A | * | 4/1948 | Marquis | 181/169 |
| 2,439,666 | A | * | 4/1948 | Marquis | 181/172 |
| 2,863,520 | A | * | 12/1958 | Manley et al. | 181/172 |
| 3,154,173 | A | * | 10/1964 | Petrie | 181/172 |
| 3,563,337 | A | * | 2/1971 | Kawamura | 181/173 |
| 3,983,337 | A | * | 9/1976 | Babb | 381/407 |
| 4,198,550 | A | * | 4/1980 | Matsuda et al. | 381/354 |
| 4,321,434 | A | * | 3/1982 | Irie | 181/173 |
| 4,324,312 | A | * | 4/1982 | Durbin | 181/171 |
| 4,433,214 | A | * | 2/1984 | Jasinski | 381/398 |
| 4,440,259 | A | * | 4/1984 | Strohbeen | 181/146 |
| 4,552,243 | A | * | 11/1985 | Melillo et al. | 181/169 |
| 5,371,805 | A | * | 12/1994 | Saiki et al. | 381/398 |
| 5,418,337 | A | * | 5/1995 | Schreiber | 181/171 |
| 5,455,396 | A | * | 10/1995 | Willard et al. | 181/172 |
| 5,740,264 | A | * | 4/1998 | Kojima | 381/423 |
| 5,748,759 | A | * | 5/1998 | Croft et al. | 381/398 |
| 6,449,375 | B1 | * | 9/2002 | Hutt | 381/403 |
| 6,611,604 | B1 | * | 8/2003 | Irby et al. | 381/398 |
| 6,697,496 | B2 | * | 2/2004 | Frasl | 381/398 |
| 6,851,513 | B2 | * | 2/2005 | Stead et al. | 181/172 |
| 6,920,957 | B2 | * | 7/2005 | Usuki et al. | 181/173 |
| 6,957,714 | B2 | * | 10/2005 | Takahashi et al. | 181/171 |
| 7,397,927 | B2 | * | 7/2008 | Pircaro et al. | 381/398 |
| 7,428,946 | B2 | * | 9/2008 | Honda et al. | 181/171 |
| 7,480,390 | B2 | * | 1/2009 | Tabata et al. | 381/398 |

* cited by examiner

*Primary Examiner* — Edgardo San Martin

(57) ABSTRACT

A surround for a diaphragm includes at least one rib section oriented to be extended during excursions of the diaphragm. The surround includes at least one membrane section supported by one or more rib sections contributing to a compliance characteristic different from the contribution of the one or more rib sections.

25 Claims, 23 Drawing Sheets

DIAPHRAGM SURROUNDING

CROSS-REFERENCE TO RELATED APPLICATION

This application is a continuation-in-part of application Ser. No. 11/756,119, filed on May 31, 2007, entitled diaphragm surround.

BACKGROUND OF THE INVENTION

This invention relates to diaphragm surrounding.

In traditional passive radiators and acoustic drivers, the surround that supports the diaphragm has a partially circular or elliptical cross-section and is made of a high durometer material to provide an approximately linear force-deflection response. Geometric non linearities at high axial excursions in some surrounds can cause dynamic instabilities, parametric excitation of sub-harmonic rocking modes, and buckling that affects the acoustic performance.

BRIEF SUMMARY OF THE INVENTION

According to the invention a surround for a diaphragm includes at least one rib section oriented to be extended during excursions of the diaphragm. There is at least one membrane section supported by the one or more rib sections with the one or more rib sections contributing to a compliance characteristic of the surround differently from the one or more membrane sections. At least one membrane section may be thinner along the direction perpendicular to the surface of the diaphragm than a rib section. The compliance characteristic may have an axial stiffness and/or a rocking stiffness. A membrane section may have concave and/or convex shapes. A rib section may have an I-bean configuration in a cross-sectional view taken along a radial direction. A rib section may have a radial dimension that is larger than a circumferential dimension. The rib section may function as a cap that seals a concave membrane section on one side and a convex membrane section on the other. There may be four membrane sections. The membrane sections may comprise two concave and two convex membrane sections. The membrane sections may have a half-row structure. The diaphragm may have an outer flange extending radially and/or an inner flange that extends radially. The outer flange may extend in a direction that is perpendicular to the surface of the diaphragm and/or the inner flange. The outer periphery of the diaphragm may be shaped to match the inner flange and the inner periphery of the attachment frame maybe shaped to match the outer flange. The diaphragm, the apparatus and the attachment frame may be assembled by gluing or chemically bonding without a separate adhesive through insert molding, the inner flange onto the edge of the diaphragm and the outer flange onto the attachment frame. The rib sections may contribute more to an axial stiffness than do the membrane sections. The concave and convex membrane sections may be arranged in a cyclic symmetric manner to increase the rocking stiffness of the apparatus.

Numerous other features, objects and advantages will become apparent from the following detailed description when read in connection with the accompanying drawing in which:

DETAILED DESCRIPTION

An active or passive acoustic source (e.g., a driver or a passive radiator) typically includes a diaphragm that reciprocates back and forth to produce acoustic waves. This diaphragm (which may be, e.g. a plate, cone, cup or dome) is usually attached to and supported by a non-moving structure through a resilient surround.

Figure 1:
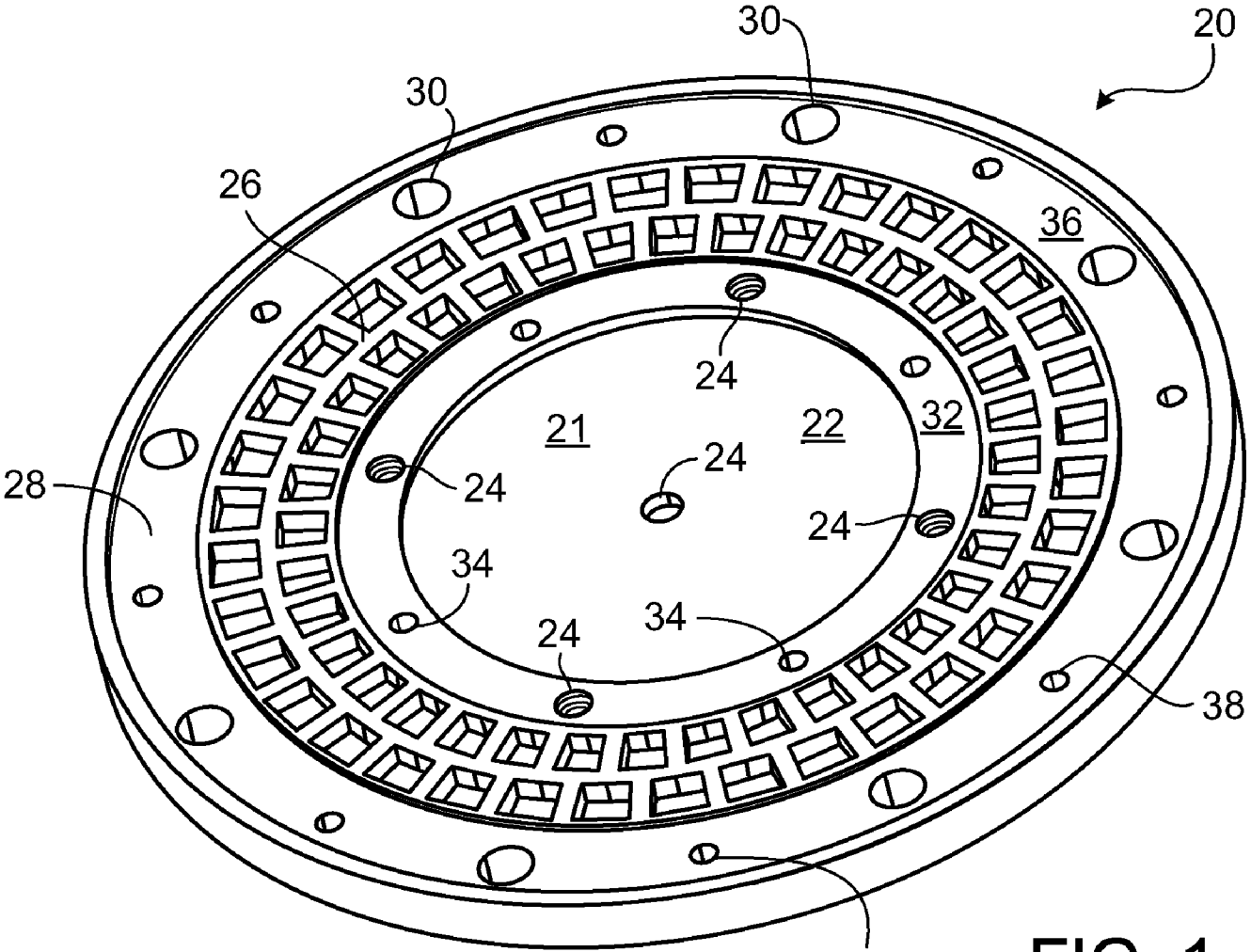
FIG. 1 is a perspective view of a passive radiator.

An example of a diaphragm and surround assembly 20 that achieves good performance (FIG. 1) includes a surround 26 that connects a diaphragm 22 to an outer attachment ring 36. In this example, the diaphragm 22 has a top surface 21 that is flat and made of a stiff material such as plastic (e.g., polycarbonate or Acrylonitrile Butadiene Styrene) or metal (e.g., steel or aluminum). In some examples, the top surface 21 of the diaphragm 22 may be convex or concave to make the diaphragm stiffer.

The diaphragm 22 is may be driven at its center 31 to produce acoustic waves by a source such as an electromagnetically driven acoustic driver (not shown). The acoustic waves are produced when the diaphragm vibrates back and forth in an intended direction 33 of travel that is substantially perpendicular to a plane 35 in which the diaphragm lies. This vibration causes additional acoustic waves to be created and propagated. A group of holes 24 in diaphragm 22 is used to secure a mass (not shown) which may be added to the diaphragm to tune to a desired resonant frequency of vibration.

In a particular example, the diaphragm 22 has a diameter of about 132 mm. The surround may be made of a solid or foam elastomer, and in this example is a thermoset soft silicone elastomer such as Mold Max 27T sold by Smooth-On. Inc., 2000 Saint John Street, Easton, Pa. 18042. Mold Max 27T is a tin-cured silicone rubber compound. Further details on Mold Max 27T can be found at www.smooth-on.com. The thermoset elastomer used to make surround 26 preferably has (i) a Shore A durometer of between about 5 to about 70, for example, about 27; (ii) a 100% elongation static modulus of between about 0.05 MPa to about 10 MPa, and for example, about 0.6 MPa; (iii) an elongation at break above about 100%, for example, about 400%; and (iv) a static stiffness of between about 0.05 newtons/mm to about 50 newtons/mm when the diaphragm is at its neutral travel position, for example, about 3 newtons/mm. However, these properties may have different values depending on the diaphragm diameter, passive radiator system tuning frequency, and air volume in the speaker box.

Generally, as the size of the surround gets smaller, a lower durometer material can be used. The use of a soft durometer material gives better design control for low in vacuo resonant frequencies of the diaphragm to keep this resonant frequency away from the tuned frequency occurring when the moving mass of the diaphragm and surround assembly resonate against the spring stiffness of the air in the speaker box and the surround stiffness.

An attachment ring 28 is secured to and supports surround 26 along an outer annular periphery 27 of the surround. The attachment ring 28 in this example is made of the same material used for diaphragm 22. The attachment ring 28 and the diaphragm 22 can be made of different materials. Ring 28 includes a series of large holes 30 along its circumference that are used with fasteners (not shown) to attach the passive radiator to another structure (discussed below).The arrangement of the attachment ring 28, the surround 26, and the diaphragm 22 provides an appropriate linear force-deflection response of the diaphragm, which can result in low harmonic distortions and good dynamic performance.

Figure 3:
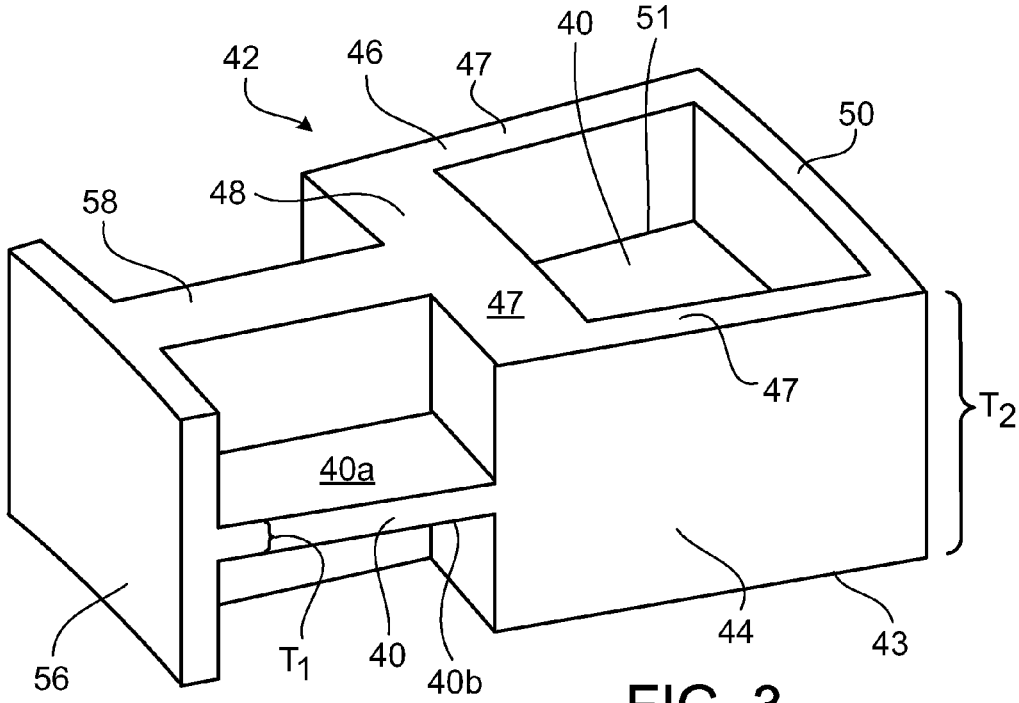
FIGS. 3, 5, 7, 9, 11, 13, 15, 17, 19, and 20 are a perspective views of portions of surrounds.
Figure 2:
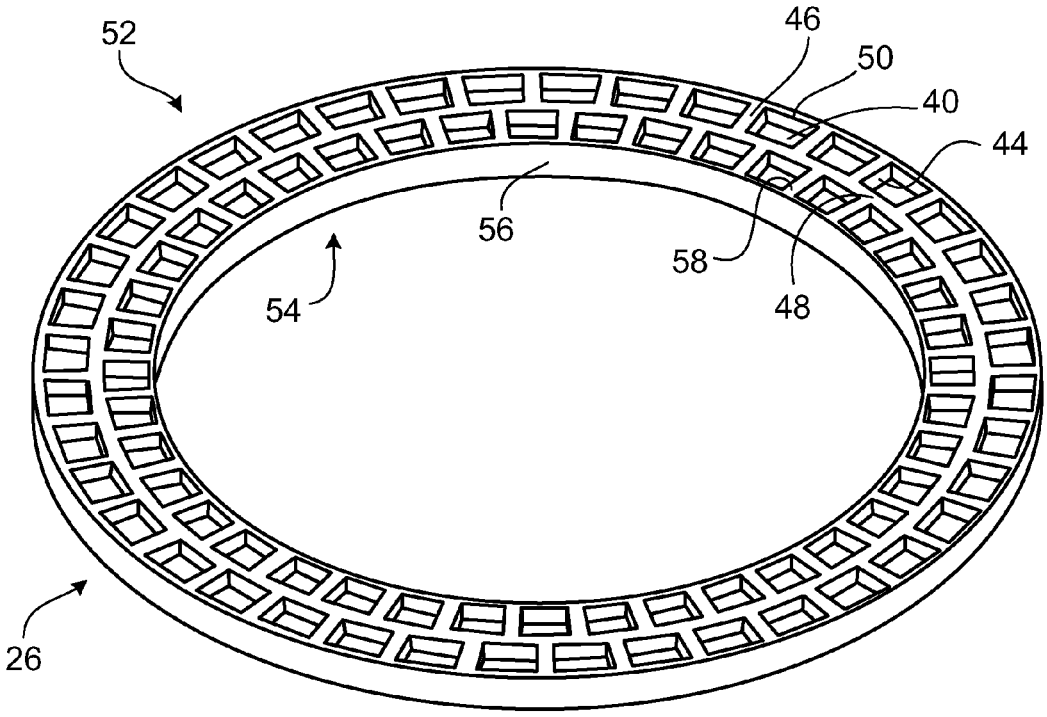
FIGS. 2, 4, 6, 8, 10, 12, 14, 16, and 18 are perspective views of surrounds.

Turning now to FIGS. 2 and 3, in some examples, the surround 26 includes generally flat (planar) membrane sections 40 which have a thickness $T_1$ of between about 0.1 mm to about 5 mm (FIG. 3). In this case, thickness $T_1$ is measured in a direction normal to opposing top and bottom surfaces 40*a* and 40*b* of membrane section 40. In this particular example, each membrane section is about 1 mm thick.

Each membrane section 40 is supported by a support section 42. In this example, the support section includes a pair of straight radial ribs 44, 46 (rib sections) as well as a circumferential rib 48, which all support membrane section 40. All three of these ribs have a thickness $T_2$ of between about 0.2 mm to about 25 mm. The ribs 44, 46 and 48 each have a surface 47 (a top surface) that is flat and perpendicular to an intended direction of travel 802 of the diaphragm 22. A bottom surface 43 of ribs 44, 46 and 48 is also flat. Thickness $T_2$ is measured in a direction normal to opposing top and bottom surfaces 47 and 43 of ribs 44, 46 and 48. An envelope that closely encompasses the surround 26 will include a substantially flat surface that is normal to an intended direction of travel of the diaphragm and coplanar with surface 47. In this example, the thickness $T_2$ is about 8.5 mm, substantially thicker than the membrane sections. The ribs of the support section symmetrically extend above and below the membrane section. The membrane and ribs are made of the same material.

The passive radiator 20 can be made by forming the diaphragm 22 and the attachment ring 28 in separate injection molding operations. The diaphragm 22 and attachment ring 28 are then placed in an insert mold and a thermoplastic or thermoset elastomer is injected into the mold. The elastomer is allowed to cure, thus forming surround 26. The thermoset elastomer covers the surfaces along the outer periphery of the diaphragm 22 and along the inner periphery of the attachment ring 28 which are adjacent the surround 26. This assists in securing (joining) the surround 26 to the diaphragm 22 and the attachment ring 28. The elastomer also preferably covers at least part of surfaces 32 and 36 (on both sides of the passive radiator 20, thereby helping to secure surround 26 to the diaphragm 22 and attachment ring 28. A series of holes 34 and 38 provide paths for molten elastomer to be injected to form the surround 26.

In operation, as the diaphragm 2 starts moving away from a home position (shown in FIG. 1), the rib sections 44, 46 and 58 start to elastically elongate along their length (in a radial direction in this example). The rib sections 44, 46 and 58 will continue to elastically elongate as the diaphragm 22 moves in an intended direction (i.e. perpendicular to a plane in which the passive radiator lies) further away from the home position. The radial ribs return to their original length when the diaphragm 22 returns to its home position. A restoring force which returns the diaphragm to the home position is attributable more to deformation of the radial rib sections 44 and 46 than to deformation of the membrane section 40. The combined volume of all the radial ribs and circumferential rib 48 for the whole surround is about 27.5 $cm^3$. The combined volume of all the membrane sections for the whole surround is about 5.4 $cm^3$. This yields a volume ratio for this example of ribs to membrane sections of about 5.1. Generally speaking, as the surround gets smaller in the radial and/or axial directions this ratio gets smaller. In some examples, this ratio is at least about 0.3.

The circumferential rib 48 extends circumferentially. Each radial rib extends away from the diaphragm along the rib's entire length in a generally radial direction (a direction perpendicular to an intended direction of travel of the diaphragm 22 and also perpendicular to the circumferential rib). Although the ribs 44, 46 are shown extending away at a 90° angle to the diaphragm 22. ribs 44, 46 can be arranged to extend at an angle less than 90° (e.g., at an angle of 60° which would result in triangular or trapezoidal membrane sections. Radial ribs 44, 46 are in an outer group of radial ribs. Membrane section 40 has a pair of edges 51 (only one edge is visible in FIG. 3) which extend in a radial direction and which are supported along their entire length by ribs 44 and 46. The interface between membrane section 40 and another element (e.g. rib 46) can be filleted. Membrane section 40 and support section 42 are connected to each other with no gap, so no air can leak past the interface between the membrane section and support section.

There are a large number of membrane sections and support sections in surround 26 arranged in two rings 52, 54 (FIG. 2). A radial rib 58 belongs to an inner group of radial ribs. The inner group of radial ribs (including rib 58) is offset radially from the outer group of radial ribs (which includes ribs 44, 46). The outer group of ribs is further from center 24 than the inner group of ribs. The inner group of radial ribs is also offset circumferentially from the outer group of radial ribs. The outer group of ribs is shifted in a circumferential direction from the inner group of ribs so that each inner rib is equidistant from its two closest outer ribs and vice versa in this example. The inner group of radial ribs are joined to the outer group of radial ribs by circumferential rib 48. The inner group of radial ribs (including rib 58) are joined to each other and connected to the diaphragm 22 by elastomer 56. The outer group of radial ribs (including ribs 44, 46) are joined to each other and connected to the attachment ring 28 by elastomer 50.

Figure 5:
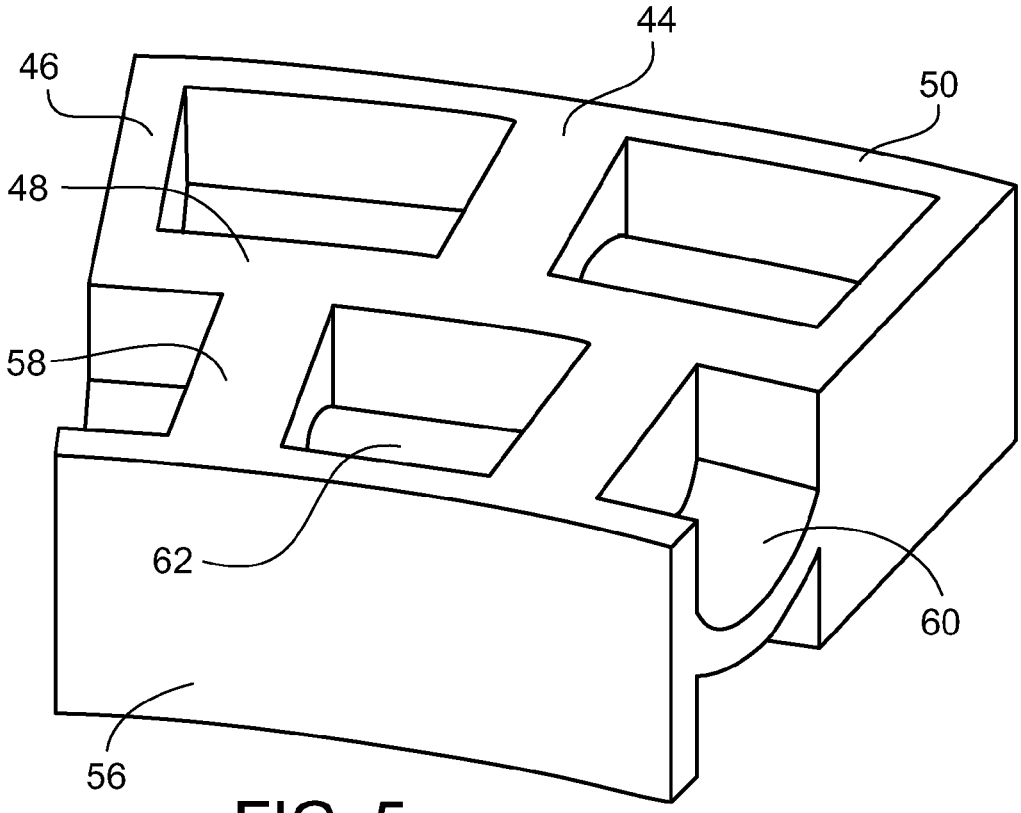
Figure 4:
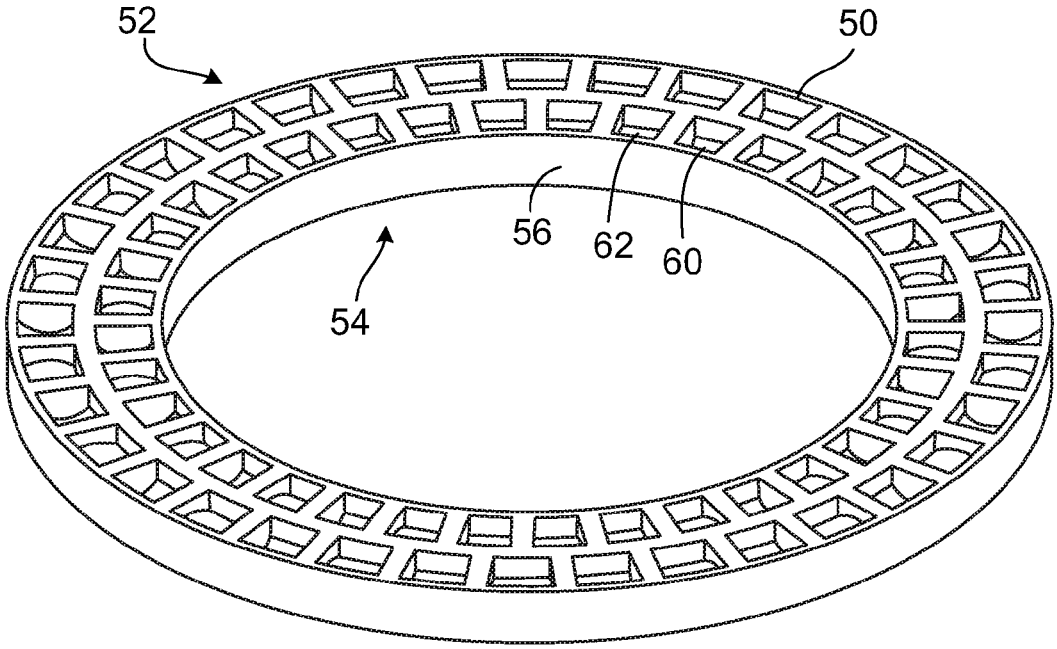

Referring now to FIGS. 4 and 5, in some examples, membrane sections 60, 62 are curved. The membrane sections alternate in a circumferential direction between concave (membrane 60) and convex (membrane 62). The membrane sections in the outer ring are also curved.

Figure 7:
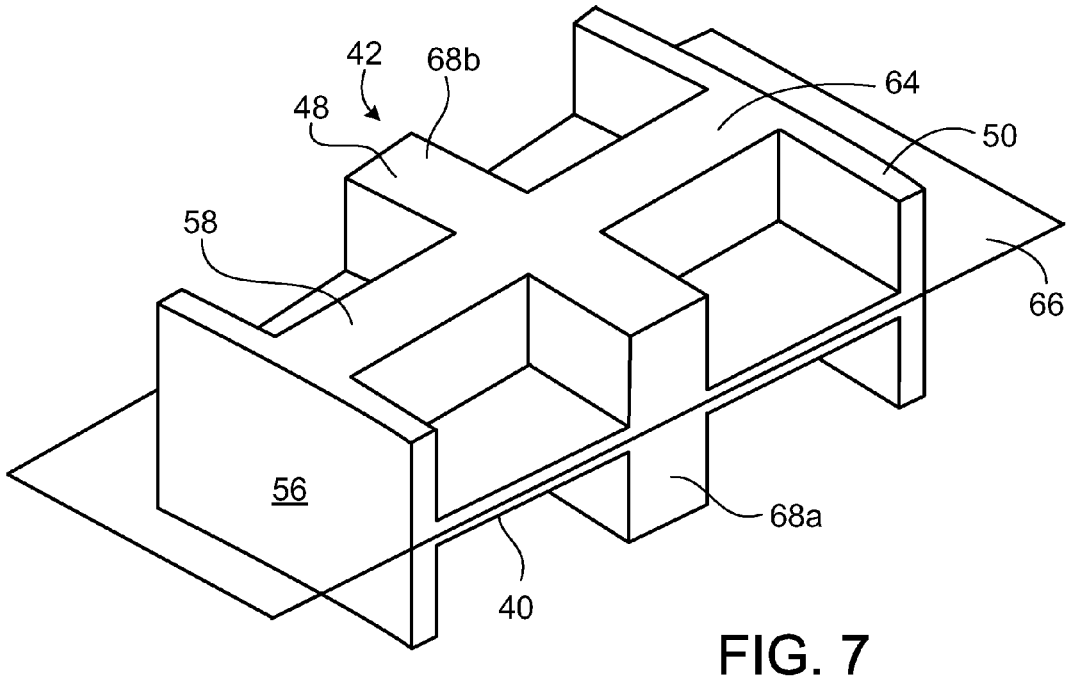
Figure 6:
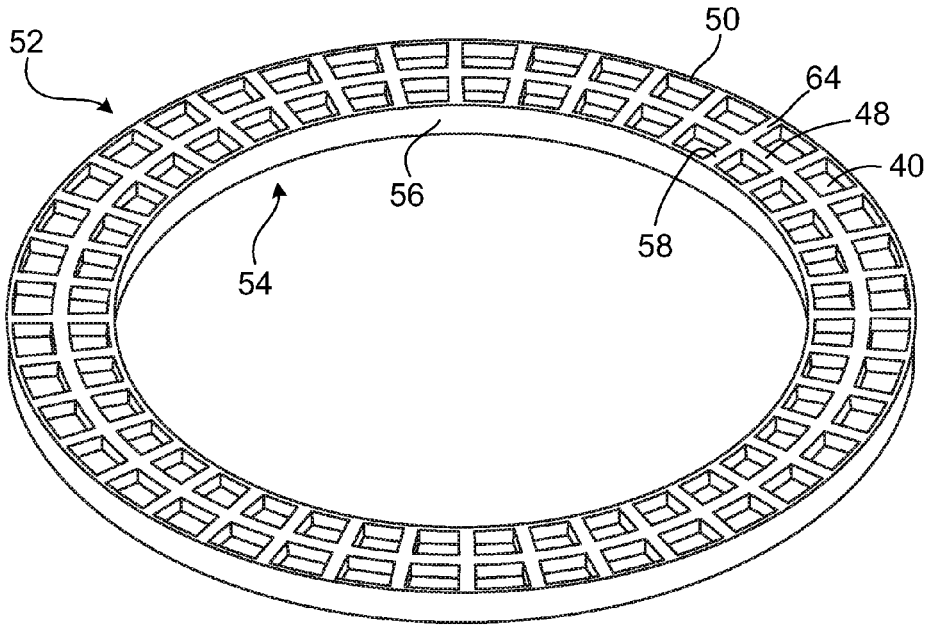

Turning to FIGS. 6 and 7, in some examples, each radial rib in the inner group (including rib 58) is aligned circumferentially with a respective radial rib in the outer group (including a rib 64).

Referring to FIG. 7, support section 42, including the radial and circumferential ribs, is symmetric about an imaginary plane 66 (this is also true for at least some of the other examples described here). Portion 68*a* lies below plane 66 and portion 68*b* lies above the plane. Diaphragm 22 (FIG. 1) preferably lies in the plane 66. Additionally, for any of the examples with flat membrane sections (e.g. FIGS. 2, 3, 6 and 7) imaginary plane 66 bisects the membrane section. Assuming that the imaginary plane 66 aligns with the point of attachment of the surround to the diaphragm and the attachment ring, the symmetry yields similar responses for the both positive and negative travels of the diaphragm from its neutral rest position.

Figure 9:
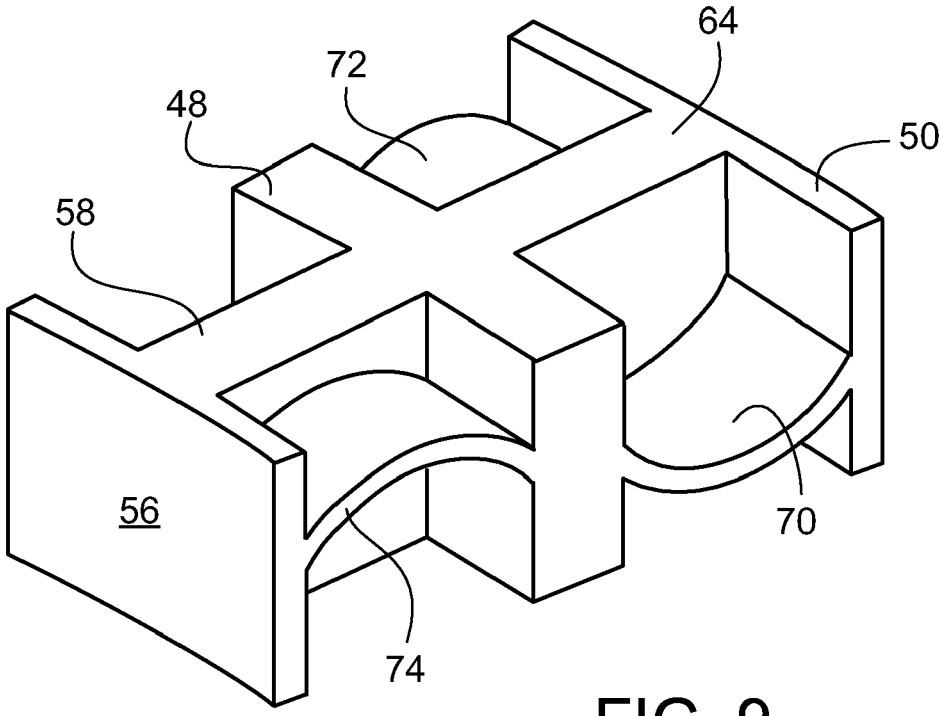
Figure 8:
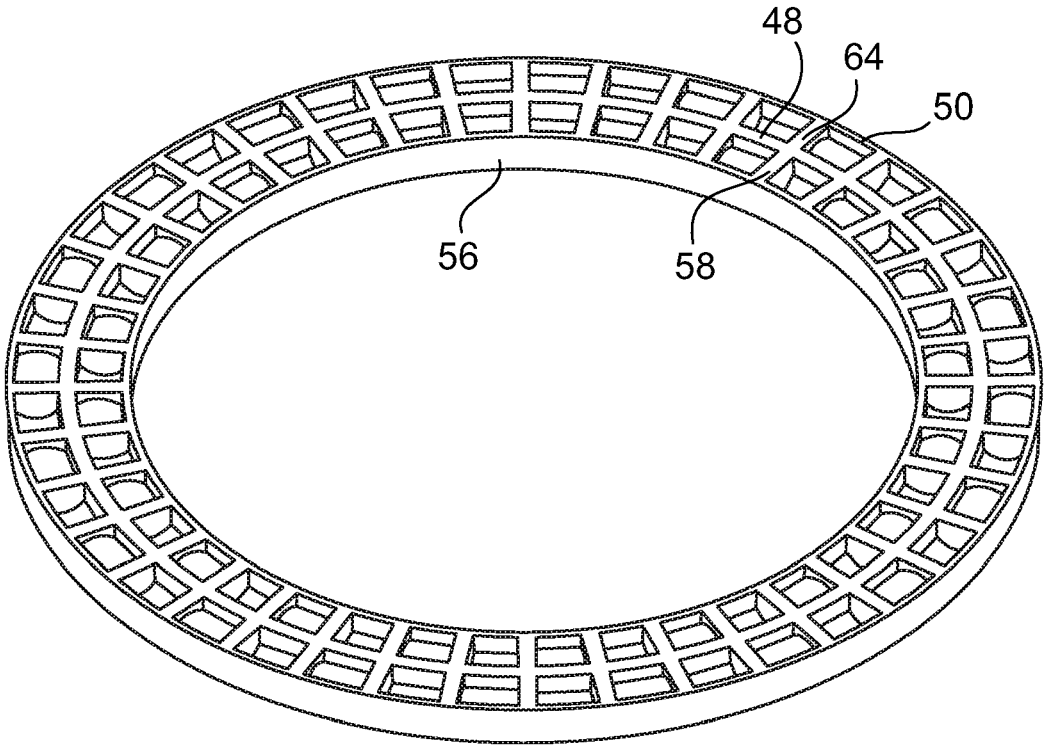

Referring to FIGS. 8 and 9, membrane sections 70, 72 are curved instead of being flat. The membrane sections alternate in a circumferential direction from being concave shaped (membrane 70) to convex shaped (membrane 72). The membrane sections also alternate in a radial direction from being concave shaped (membrane 70) to convex shaped (membrane 74).

Figure 11:
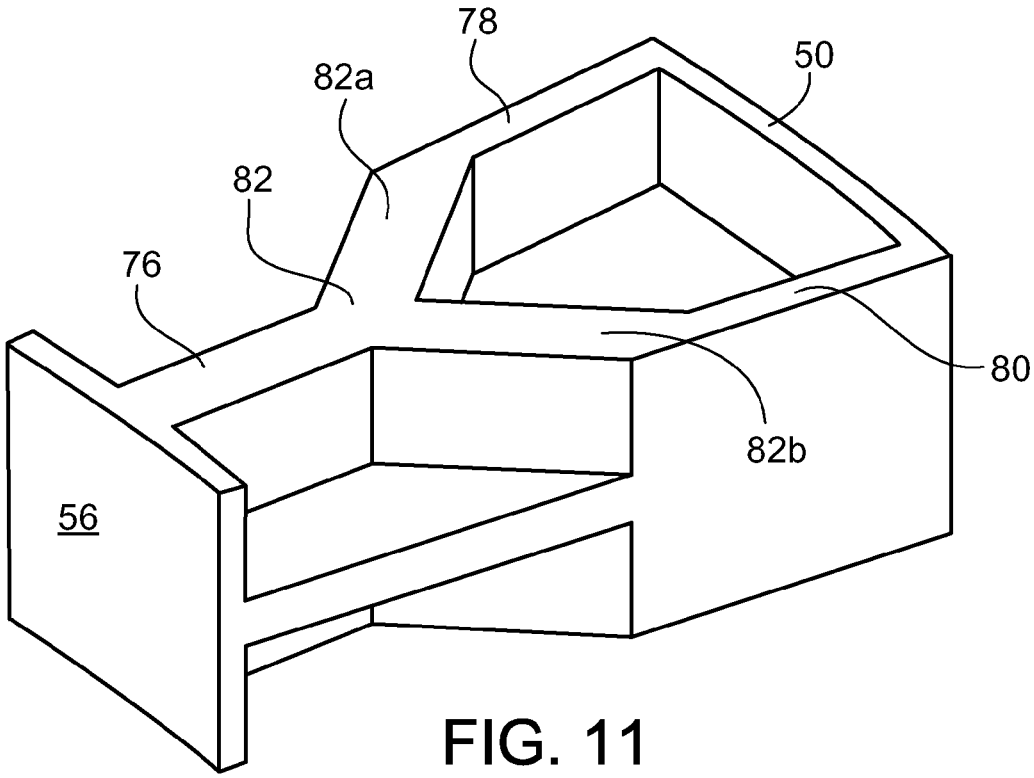
Figure 10:
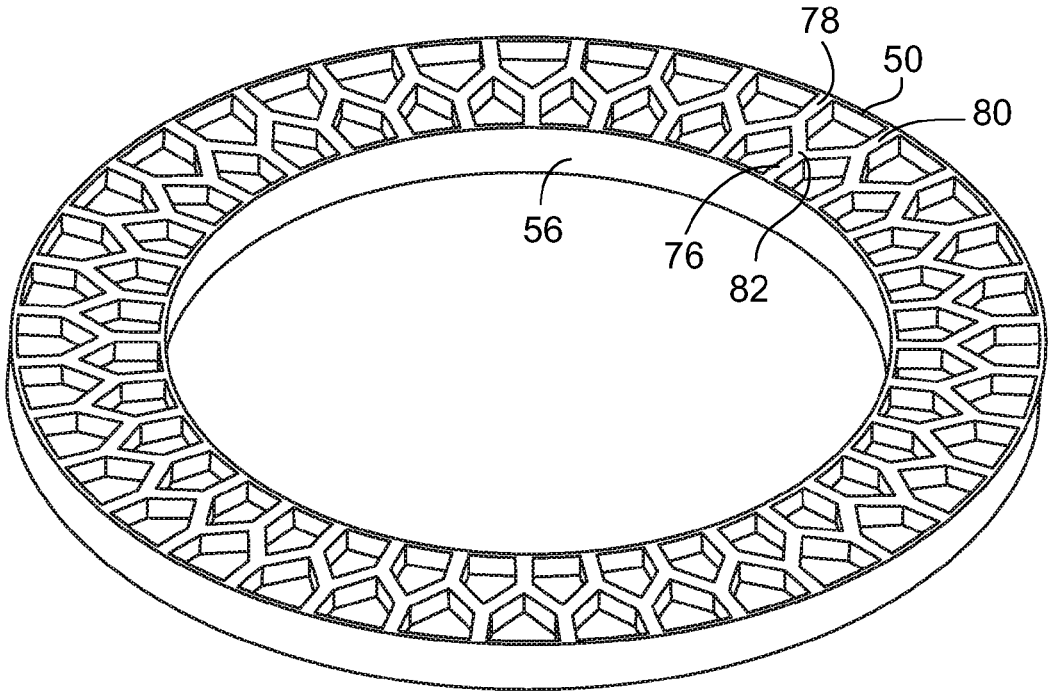

Referring now to FIGS. 10 and 11, (a) radial ribs 44, 46 and 58 can be replaced by shortened (in the radial direction) radial ribs 78, 80, 76 and (b) circumferential rib 48 can be replaced by a zigzagging rib 82 having a multiplicity of short rib sections 82*a*, 82*b*. Each membrane section is then pentagonal.

Figure 13:
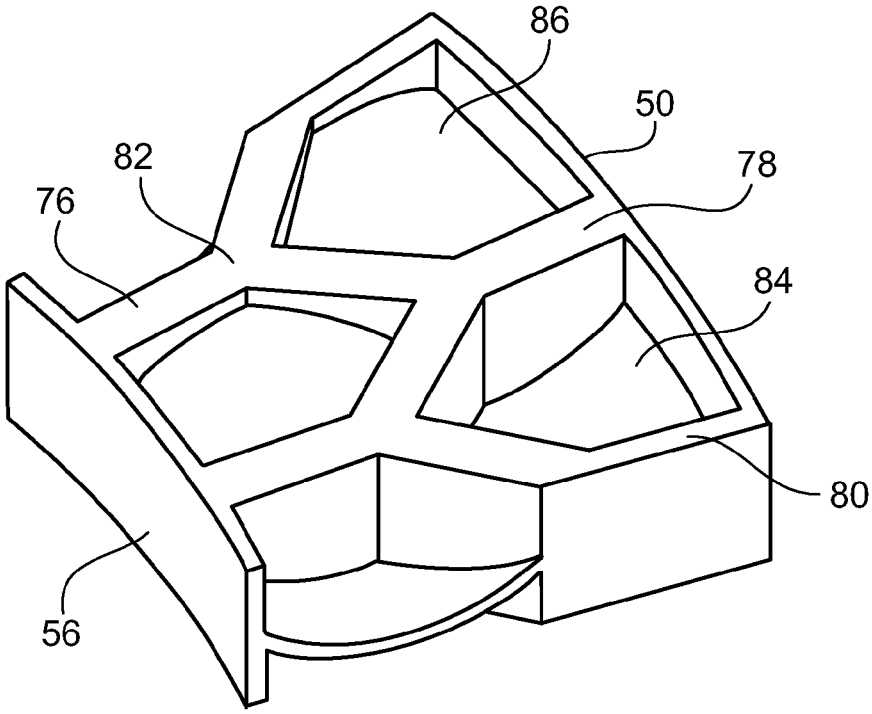
Figure 12:
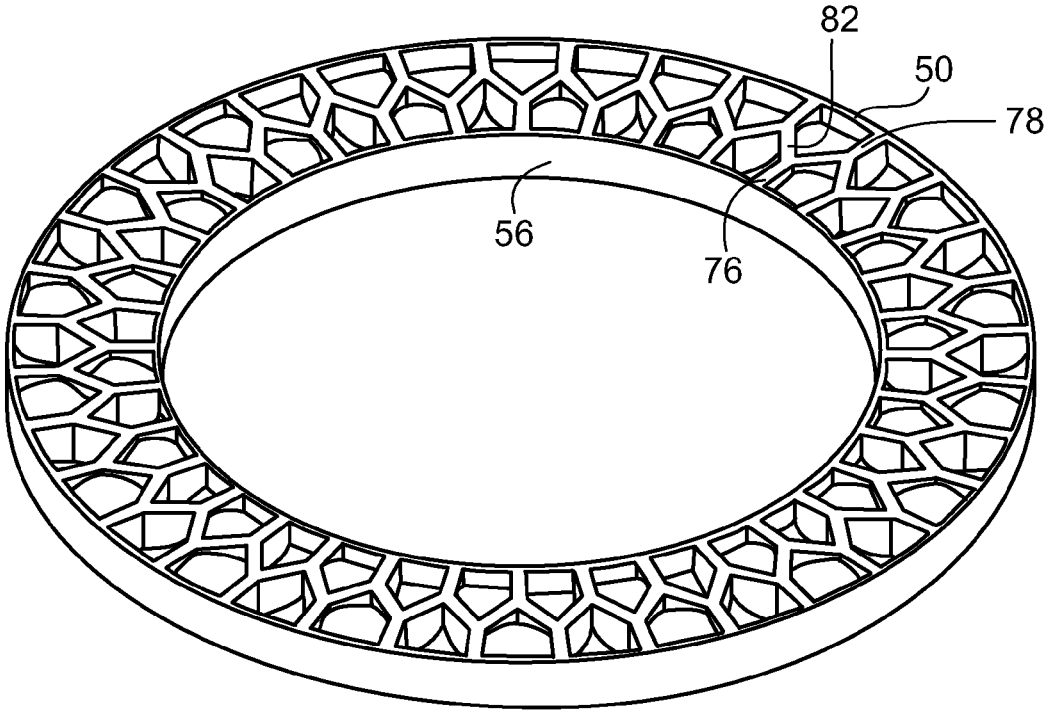

With reference to FIGS. 12 and 13, a further example of a surround is shown that is similar to the example shown in FIGS. 10 and 11 except that membrane sections 84, 86 are curved instead of being flat. The membrane sections alternate in a circumferential direction from being concave shaped (membrane 84) to convex shaped (membrane 86).

Figure 15:
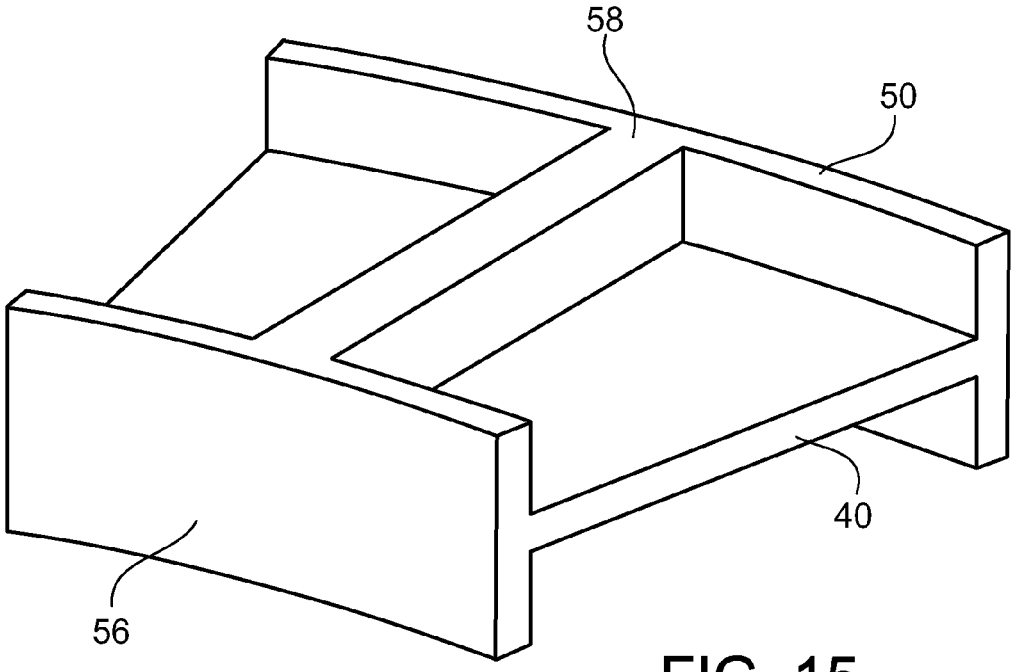
Figure 14:
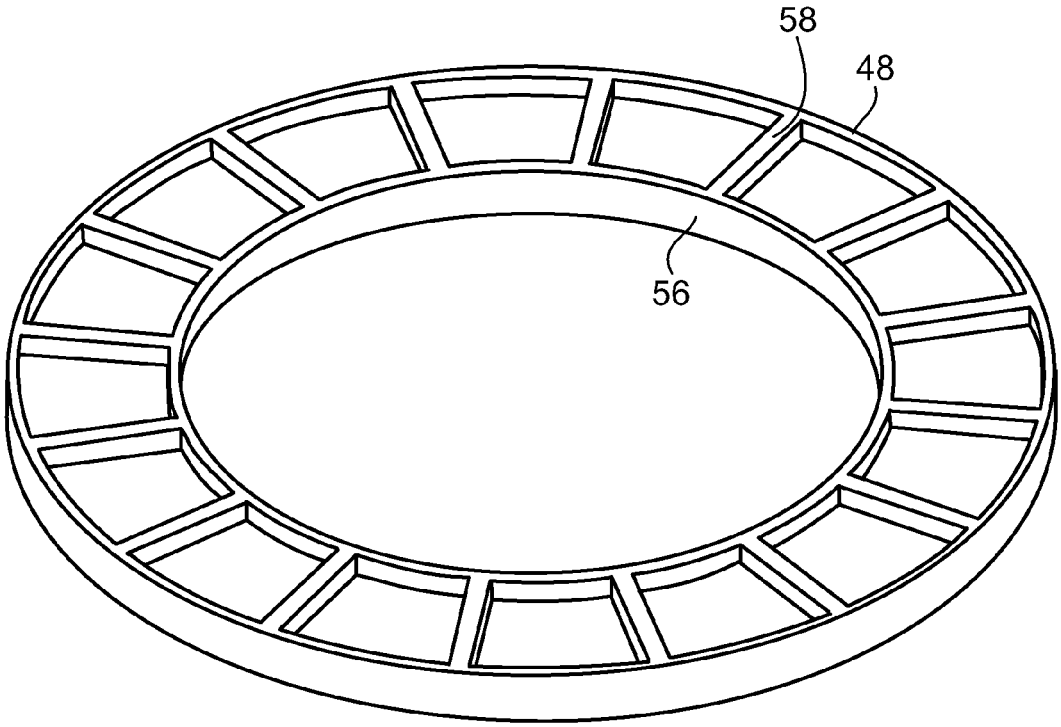

Referring now to FIGS. 14 and 15, another example is shown that is similar to the example shown in FIGS. 2 and 3 except that circumferential rib 48, the radial ribs in outer annular ring 52, and the membrane sections in outer annular ring 52 have been eliminated. This arrangement might be used for supporting a smaller diaphragm whereas the previous examples might be used to support a larger diaphragm.

Figure 17:
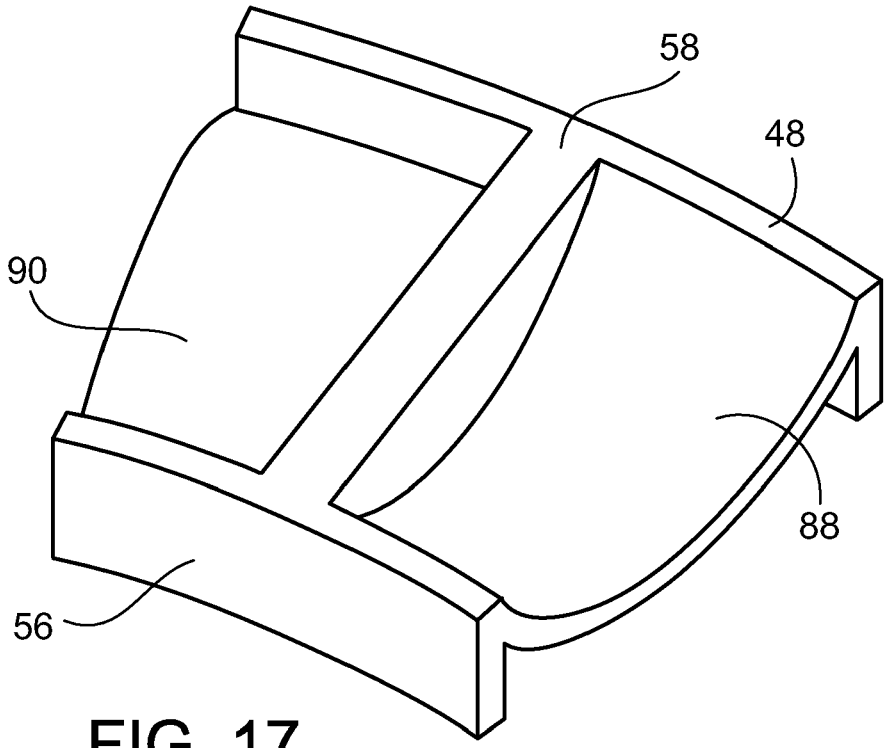
Figure 16:
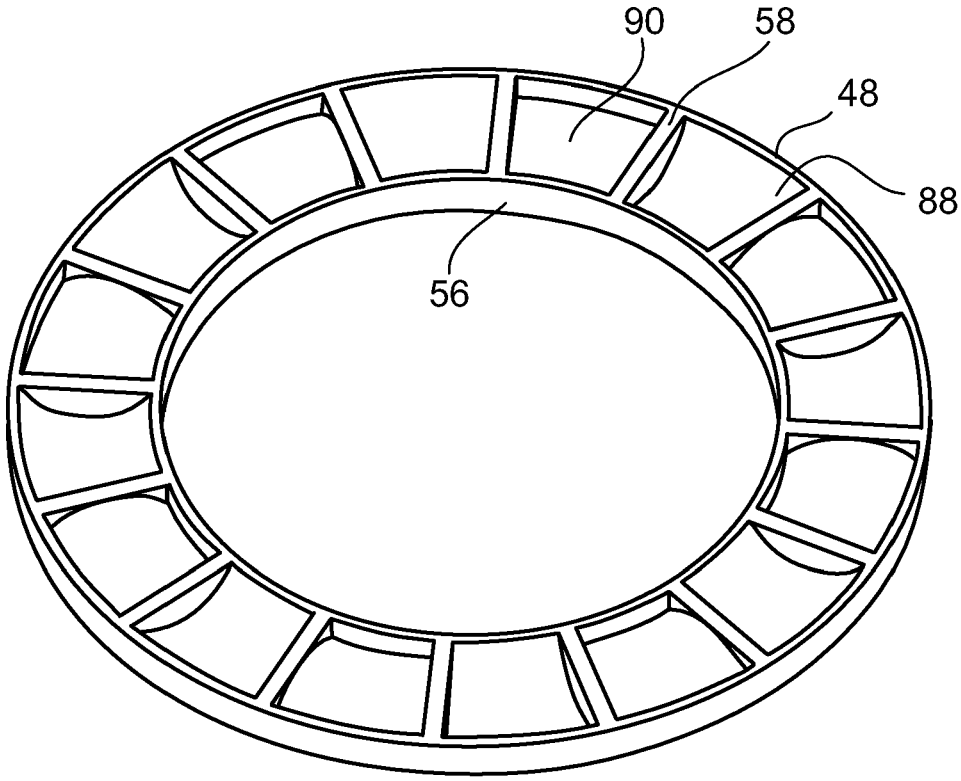

With reference to FIGS. 16 and 17, a further example of a surround is shown that is similar to the example shown in FIGS. 14 and 15 except that membrane sections 88, 90 are curved instead of flat. The membrane sections alternate in a circumferential direction from being concave shaped (membrane 88) to convex shaped (membrane 90).

Figure 19:
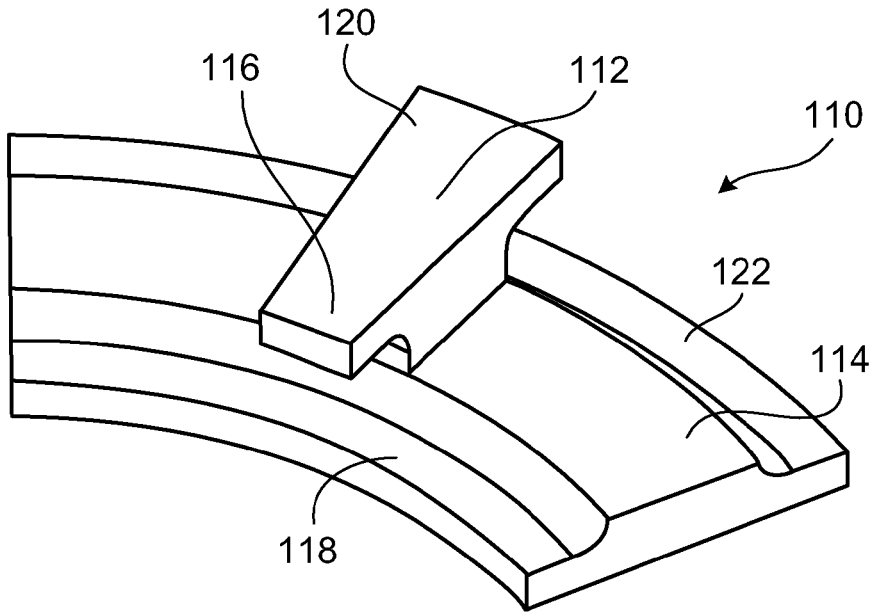
Figure 18:
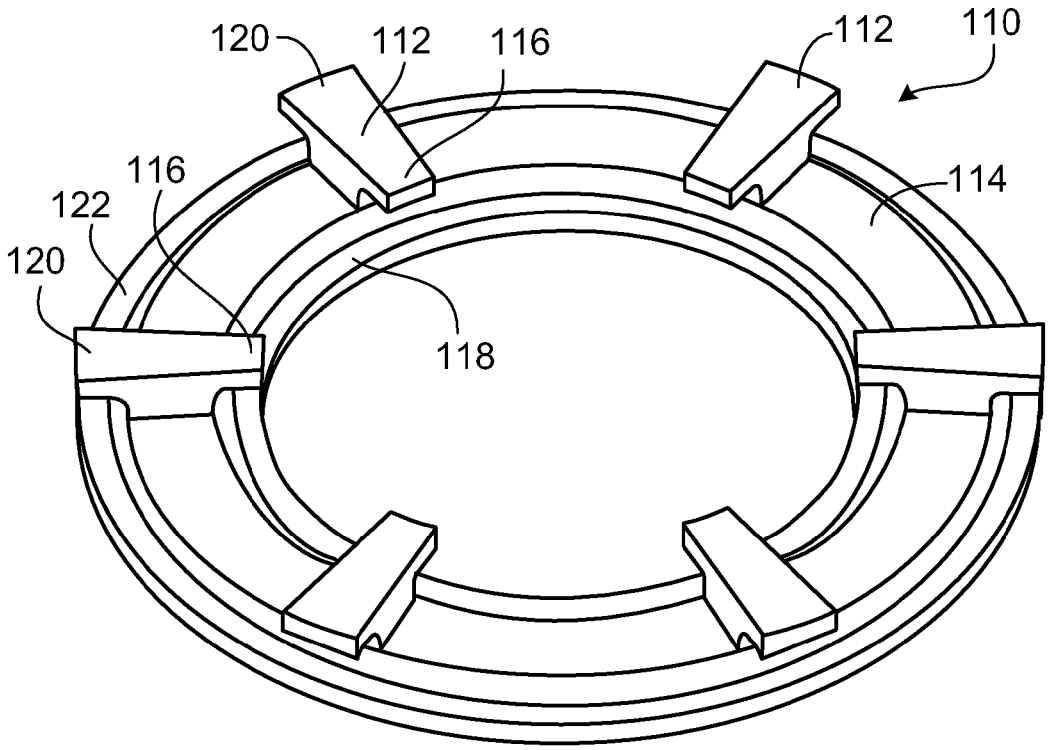

Turning to FIGS. 18 and 19, a surround 110 includes six radial ribs 112 and a membrane 114. The ribs 112 sit on top of the membrane 114. A diaphragm (not shown) is located between a first lip 116 of the ribs 112 and a first lip 118 of the membrane 114. An attachment ring is located between a second lip of the ribs 120 and a second lip 122 of the membrane 114. The surround 110 is insert molded to a preformed diaphragm and attachment ring.

Figure 20:
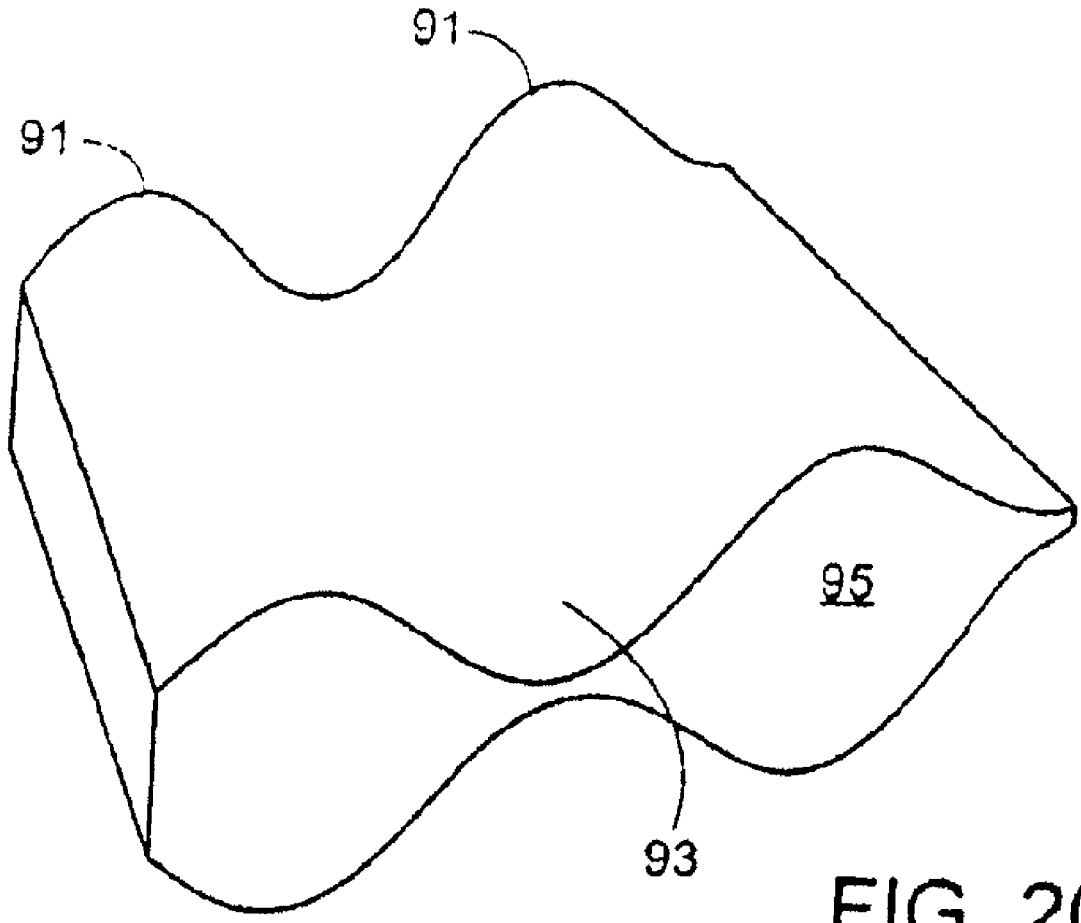

FIG. 20 provides another example of a surround. A pair of radial ribs 91 support a membrane section 93. In this example there is no clear line of demarcation between where the ribs end and where the membrane section begins. A portion 95 of the surround is secured to either a circumferential rib or to an attachment ring (not shown). A portion of the surround opposite the portion 95 is secured to a diaphragm (not shown).

In general, the ribs of the support section provide a linear force-deflection response and the thin membrane provides a non-linear force deflection response. The total stiffness is a combination of the ribbed and the membrane responses so it is desirable to minimize the contribution of the membrane. One example provides a linear performance of the system over a 22 mm peak-to-peak travel of the diaphragm. In one example using a soft silicone rubber the rubber goes through an elongation or strain of about 30%.

Figure 21A:
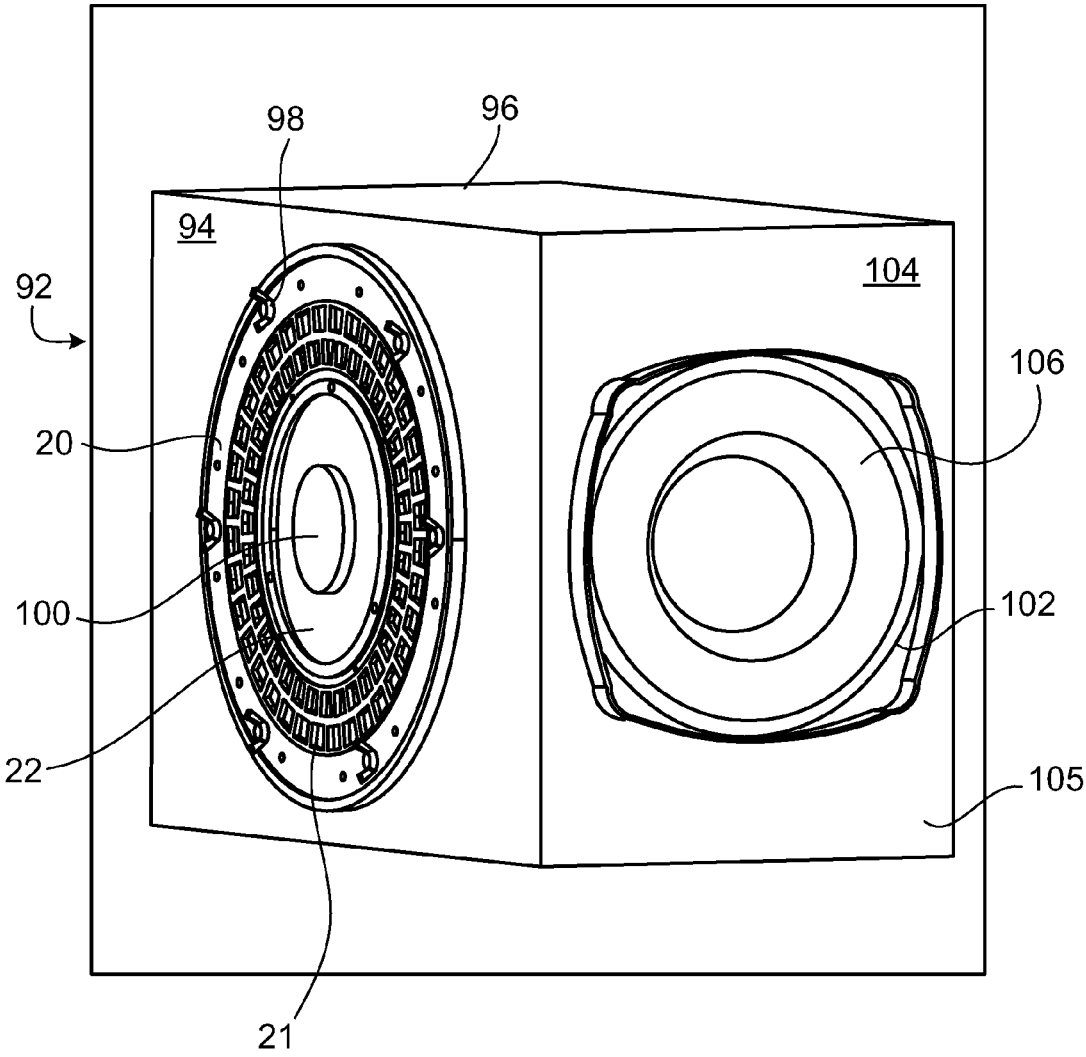
FIG. 21A is a perspective view of a speaker.

As shown in FIG. 21A, a speaker 92 has an acoustic driver 102 and a passive radiator 20 mounted on two sides 94, 104 of a closed housing 105 of the speaker 92. The sides 94 and 104 are perpendicular to one another. The acoustic driver 102 has a diaphragm 106 that vibrates when driven by electrical signals. The vibration of the diaphragm 106 propagates through air inside the speaker 92 and causes the diaphragm 22 of the passive radiator 20 to vibrate. Surrounding the diaphragm 22 is the passive radiator surround 21. The physical and geometrical characteristics of the surround 21 affect the characteristics of the vibrating movement of the diaphragm 22. The surround 21, being made of elastic materials, pulls the diaphragm back when the diaphragm moves away from a neutral position, by generating a restoring force. A surround made of more rigid material will tend to generate a larger restoring force, and to induce faster but smaller movements in the diaphragm attached to it. A surround made of softer material will tend to generate a smaller restoring force, and to induce slower but larger movements in the diaphragm.

The passive radiator 20 augments the vibrating movement of the acoustic driver 102. The acoustic waves together generated by the acoustic driver 102 and the passive radiator 20 as perceived by a listener define sound qualities of the speaker 92. It is desirable that the diaphragm 22 of the passive radiator 20 replicate the vibrating movement of the diaphragm 106 of the acoustic driver without any distortion. Distortion occurs when a restoring force generated by the surround is non-linear or when the surround generates a rotating torque that rocks the diaphragm.

Figure 21B:
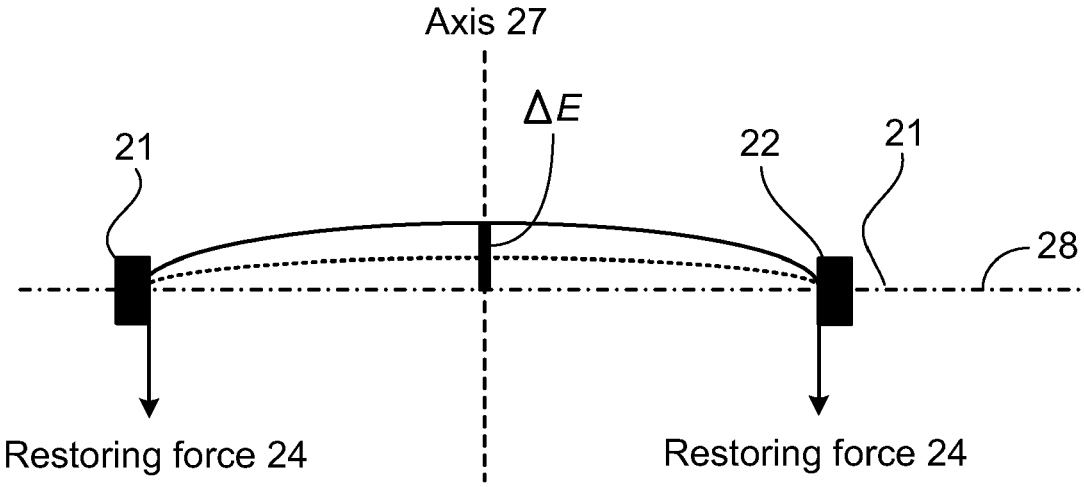
FIG. 21B shows a schematic cross-section of a vibrating diaphragm.

FIG. 21B illustrates the vibrating motion of the diaphragm 22. As the diaphragm 22 moves away from a neutral position, plane 28, along the axis 27, restoring forces 24 generated by the surround 21 pull the diaphragm 22 back to its neutral position, plane 28.

Figure 21C:
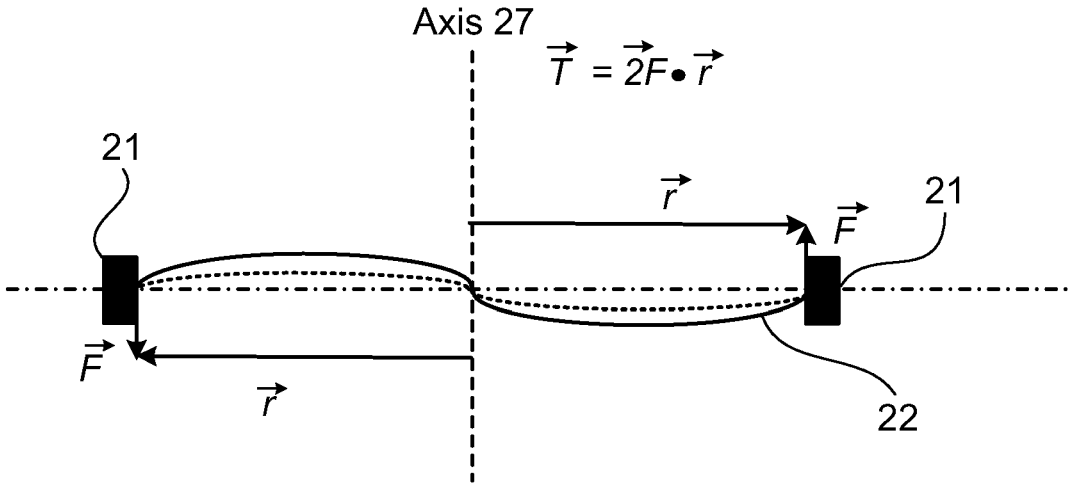
FIG. 21C shows a schematic cross-section of a rocking diaphragm.

FIG. 21C illustrates the rocking motion of the diaphragm 22 about an axis 27. The diaphragm 22 in FIG. 21C is rocking as the left side of the diaphragm 22 moves upward and the right side of the diaphragm 22 moves downward. The rocking motion is caused by a torque, which is defined as:

$$\vec{T}=2\vec{F}\cdot\vec{r}$$

In surrounds, it is desirable to attain a linear restoring force in the surround as the diaphragm moves away from its neutral position along the axis 27 and to minimize rotating torque in the surround to reduce rocking motion in the diaphragm. The tendency of a diaphragm to return to its neutral position after being displaced along the axis 27 is measured by its axial stiffness coefficient, which can be expressed as restoring force per unit excursion. The tendency of a diaphragm to return to its normal orientation after rocking is measured by its rocking stiffness coefficient, which can be expressed as restoring torque per unit angle displacement. Rocking stiffness, in turn, determines a rocking frequency of the diaphragm, the frequency at which the diaphragm rocks resonantly, an undesirable state in which the rocking movement of the passive radiator's diaphragm can be significant and the distortion of the diaphragm pronounced. For a particular diaphragm, the higher the rocking stiffness, the higher the rocking frequency.

Figure 22C:
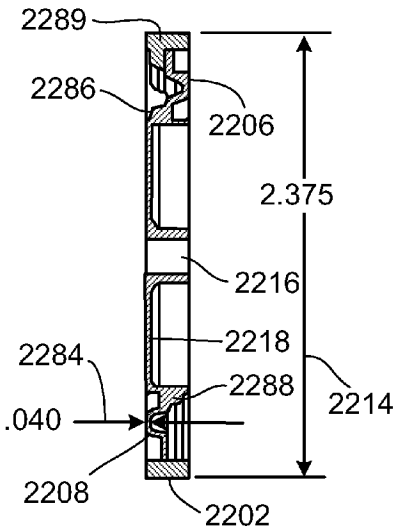
FIGS. 22B and 22C; 24B and 24C; 25B and 25C; 26B and 26C; and 27B and 27C are side sectional and front sectional views of diaphragm and surround assemblies.
Figure 22A:
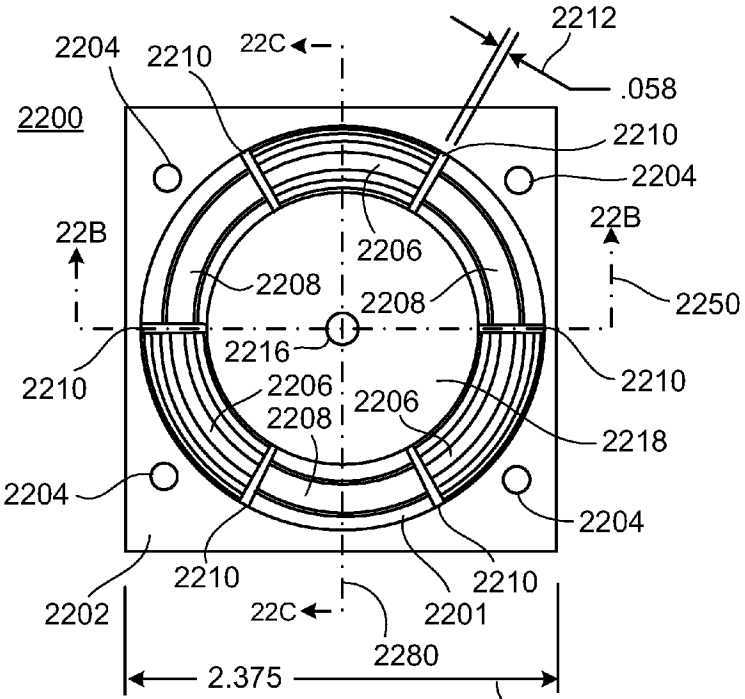
FIGS. 22A, 24A, 25A, 26A, and 27A are top views of a diaphragm and surround assemblies.
Figure 22B:
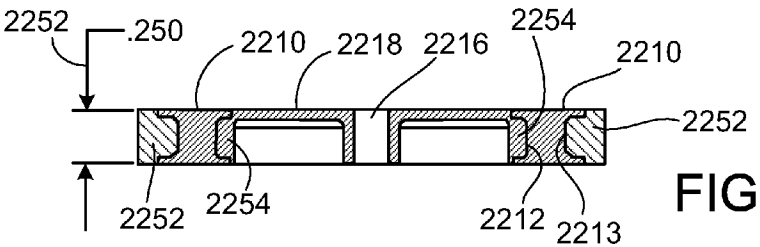

FIGS. 22A, 22B, and 22C show an example of a surround assembly 2200 designed to provide more linear restoring forces and to reduce rocking motion of the diaphragm 2218 attached to the surround 2201. The surround assembly 2200 includes a surround 2201, a square attachment frame 2202, and a diaphragm 2218, which can be assembled using an adhesive rather than forming the three parts together in a molding process.

The inner periphery 2220 of the attachment frame 2202 supports and is attached to the surround 2201 and the attachment frame holds the surround assembly 2200 on the speaker 92 using fasteners that pass through the four holes 2204. The attachment frame can also be a ring, or another shape.

A mass (not shown) of a selected size is mounted in a central hole 2216 in the diaphragm. Adjusting the mass of the object tunes the resonant frequency of the speaker 92 occurring when the moving mass of the diaphragm and surround assembly resonate against the spring stiffness of the air in the speaker box and the surround stiffness.

The surround 2201 is segregated into six arc sections, 2206 and 2208, by six ribs 2210. The ribs 2210 each have a thickness 2212 of 0.058 inches. The six sections will be referred to as membranes in the rest of the application although the sections can be in any shapes and configurations. Membrane includes any shape or configuration, and there can be other numbers of sections including as few as two and as many as eight or more. Among the six membranes, three of them, sections 2208, have a convex shape, and three of them, sections 2206, have a concave shape. The convex and concave membranes alternate around the surround.

Two cross-sectional views of the surround assembly 2200 are taken to further illustrate the shapes of the ribs 2210 and the membranes, 2206 and 2208. The cross-sectional view FRONT-FRONT 2250 is depicted in FIG. 22B to show the cross-section of the diaphragm 2218 and the ribs 2210. The cross-sectional view RIGHT-RIGHT 2280 is depicted in FIG. 22C to show the cross section of the diaphragm 2218, the concave membranes 2206, and the convex membranes 2208.

In referring to FIG. 22B, the cross-sectional view 2250 shows two ribs 2210. Each rib has an I-beam configuration. The two sides 2211, 2213 of each of the ribs 2210 curve inward. The attachment frame 2252 and the diaphragm 2218 bulge outward to match the inward curves of the two sides, 2212 and 2213. The recessed parts of the rib 2210 allow the attachment frame 2252 and the diaphragm 2218 to fit snuggly into the rib 2210.

In referring to FIG. 22C, the material that makes the membranes 2206 and 2208 has a thickness 2284 of 0.040 inches. The membranes 2206 and 2208 in FIG. 22C have a half-roll structure. But the membranes can be of any other curve or shape, for example, elliptic, angular, oval or rectangular. Extending from both sides of the membrane 2208 are two annular and alternating flange sections 2288. The flange sections 2288 on the inside of the membrane 2208 are attached to the diaphragm 2218. The flange sections 2288 on the outside of the membrane 2208 are attached to the attachment frame 2202. The membranes 2208 have the same flange arrangement (not shown).

The diameter 2214 of the surround assembly 2200 is 2.375 inches and the thickness 2252 of the surround assembly 2200 is 0.250 inches as indicated in the cross-sectional view 2250 in FIG. 22C.

Figure 23A:
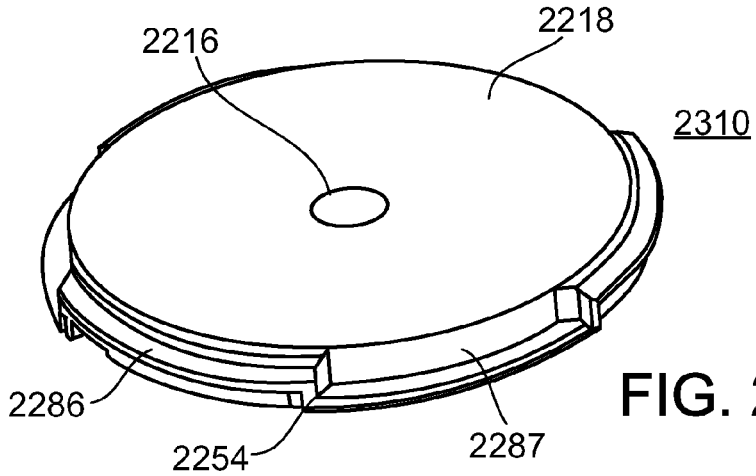
FIG. 23A is a perspective view of a diaphragm.
Figure 23B:
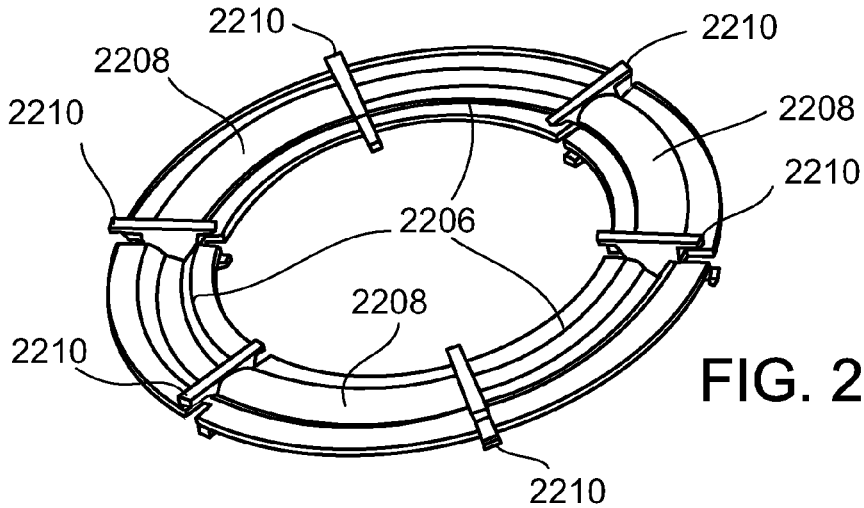
FIG. 23B is a perspective view of a surround.
Figure 23C:
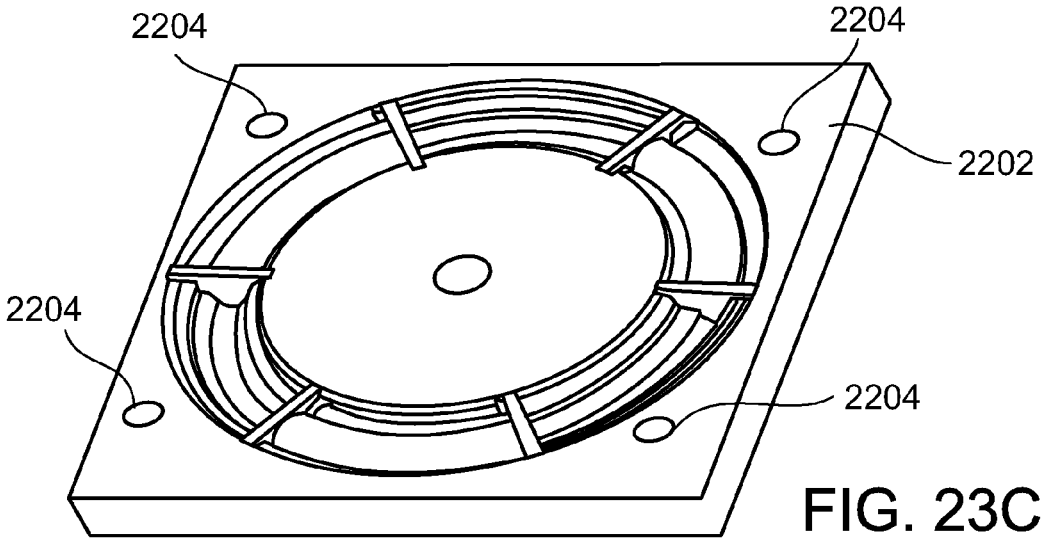
FIGS. 23C and 24D are perspective views of a diaphragm and surround assemblies.

FIGS. 23A and 23B depict the diaphragm 2218 and the surround 2201 as individual parts and FIG. 23C depicts the diaphragm 2218 and the surround 2201 as being assembled into the surround assembly 2200. In FIG. 23A, the perspective view 2310 of the diaphragm 2218 shows that the edge of the diaphragm is shaped to match the flange arrangement on the convex and concave membrane sections of on the surround. The edge of the diaphragm 2218 includes a sunken section 2287, a raised section 2286, and a narrow protruding section 2254. The narrow protruding section 2254 fits into the recessed parts of the ribs 2210. The flanges of the concave membrane sections 2206 can be fitted onto the raised sections 2286 and the flanges of the convex membrane sections 2208 can be fitted onto the sunken sections 2287.

On the surround 2201, each rib, 2210, is situated between a concave membrane 2206 and a convex membrane 2208 and acts as a cap that seals the ends of the membranes. The upper section of each rib 2210 caps a convex membrane 2208 on one side and the lower section of each rib 2210 caps a concave membrane 2206 on the other side. Each rib 2210, having an I-beam configuration, has a flat top and bottom that extend slightly over the membrane sections.

Assembly of the diaphragm 2218 into the surround 2201 can be carried out by fitting the inner flanges of the membranes of the surround 2201 onto the receiving sections 2286 and 2287 of the diaphragm 2218, and fitting the outer flanges of the membranes of the surround 2201 onto the rim of the attachment frame, and then fitting the protruding sections 2252 of the attachment frame and the protruding sections 2254 of the diaphragm into the recessed parts of the ribs 2210. The parts can be glued together or chemically bonded by molding the surround with the diaphragm and attachment frame in place by using materials that will bond to each other with or without a primer applied to the inserted parts.

Figure 24C:
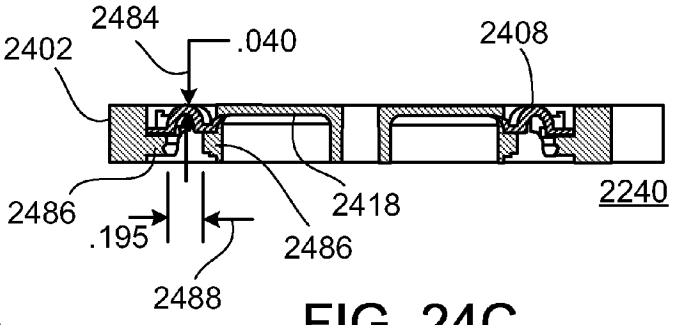
Figure 24D:
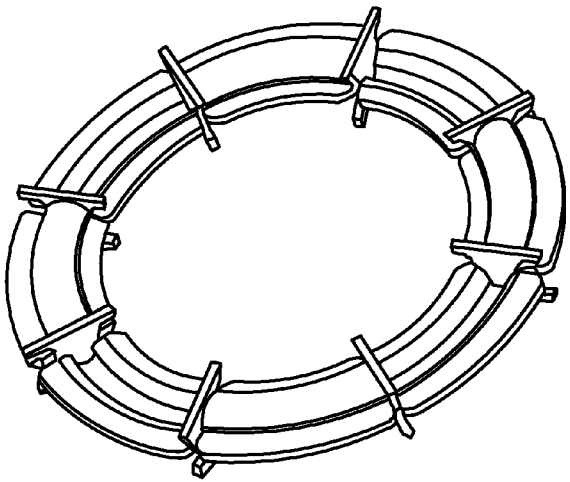
Figure 24A:
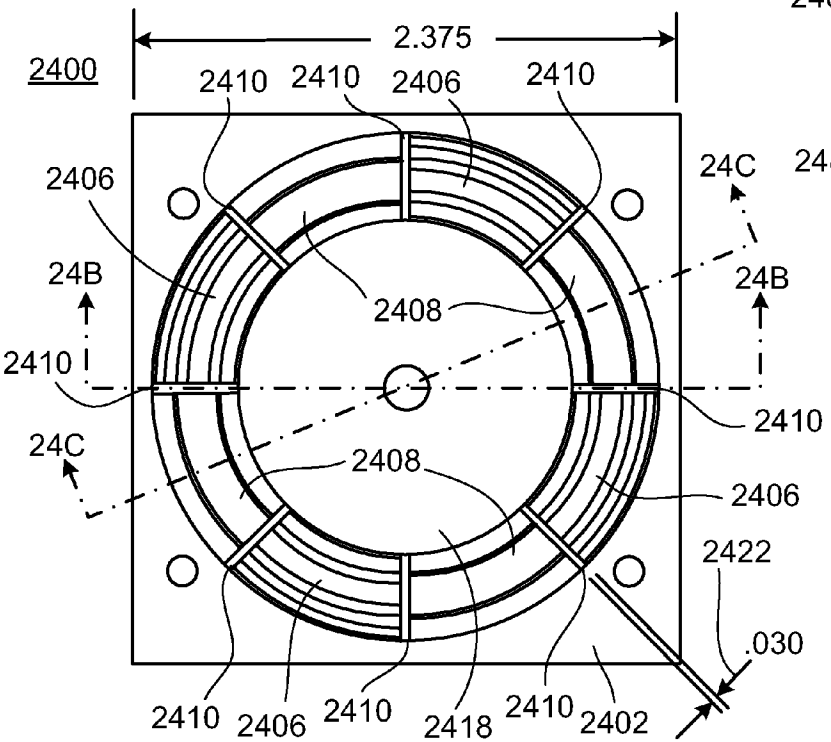
Figure 24B:
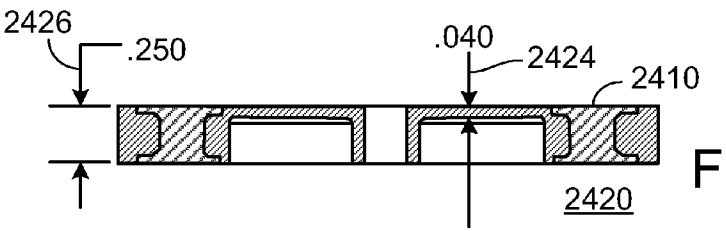

Another example of a surround assembly 2400 is shown in FIGS. 24A, 24B, 24C, and 24D. In FIG. 24A, the surround assembly 2400 includes three parts, an attachment frame 2402, a diaphragm 2418, and a surround 2401. Compared to the surround assembly 2200 in FIG. 22A, the attachment frame 2402 is similar to the attachment frame 2202, and the diaphragm 2418 to the diaphragm 2218. But the surround 2401 is divided into eight arc sections, 2406 and 2408, by eight ribs, 2410, instead of six arc sections by six ribs as is the case for the surround 2201. Other than the number of arc sections, the surround 2401 is similar to the surround 2201 in several aspects.

For example, each rib 2410 caps a concave membrane 2206 and a convex membrane 2208 that are situated on either side of the rib and has a flat top and bottom that extend slightly over the membrane sections, as shown in FIG. 24D. Also, as shown in the cross sectional view FRONT-FRONT 2420 in FIG. 24B, the ribs 2410 have the same I-beam configuration as the ribs 2210 and the thickness 2424 of the diaphragm and the thickness 2426 of the surround assemble are the same as those of the surround assemble 2200. The cross sectional view 22.5-22.5 2440 shown in FIG. 24C presents the cross section of two convex membrane sections 2408, the diaphragm 2418, and the attachment frame 2402, that is similar to the cross section presented in FIG. 22C. Each convex membrane 2408 has a thickness 2484 of 0.04 inches and the circular part of each convex membrane 2408 has a diameter 2488 of 0.195 inches. Each convex membrane 2408 also has two flange sections 2486 that can be used to fit into the diaphragm 2418 and the attachment frame 2402. Each concave membrane 2406 (not shown in FIG. 24C) has the same geometrical dimensions as the convex membrane 2408.

Figure 25C:
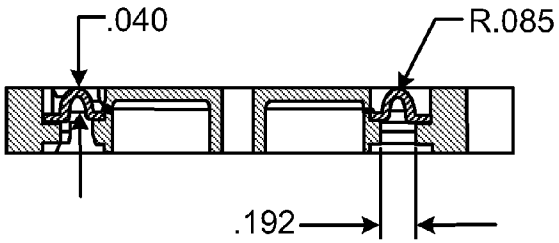
Figure 25A:
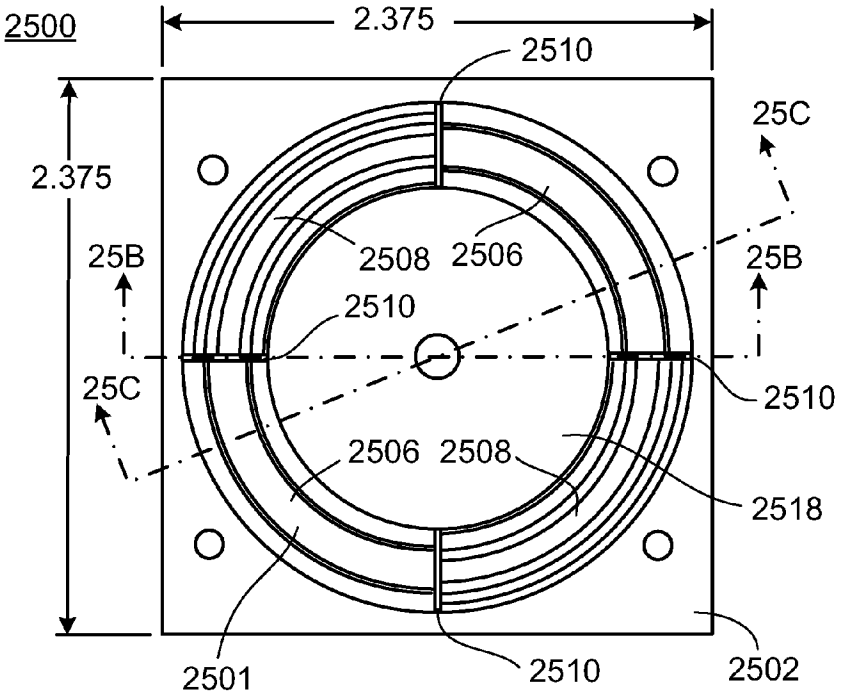

FIG. 25 shows another example of a surround assembly 2500. The surround 2501 in the surround assembly 2500 is divided into four arc sections, 2506 and 2508, by four ribs, 2510. Two of the arc sections, 2506, are of convex shape and two of the arc sections, 2508, are of concave shape. With respect to the geometric dimensions and shapes, the surround assembly 2500 is similar to the surround assemblies 2400 and 2200.

Figure 25B:
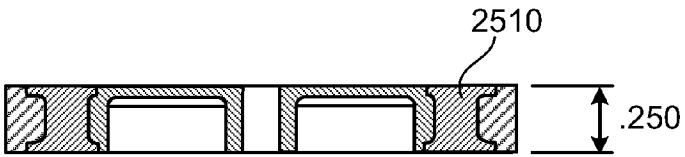
Figure 26B:
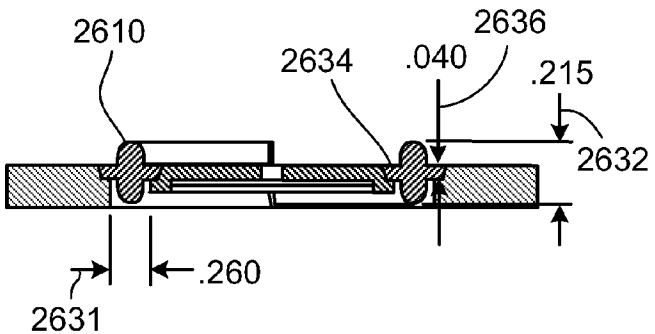
Figure 26A:
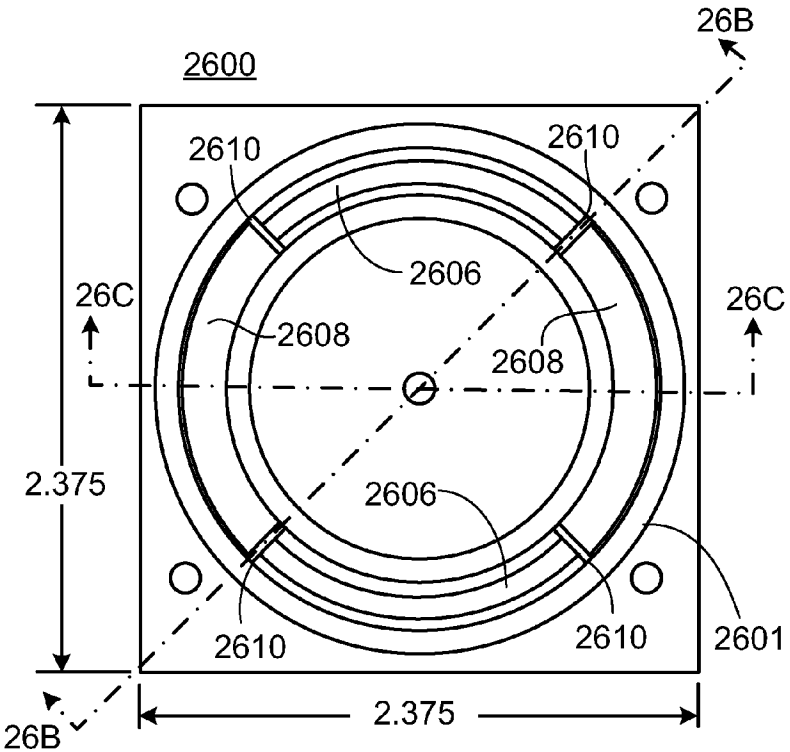
Figure 26C:
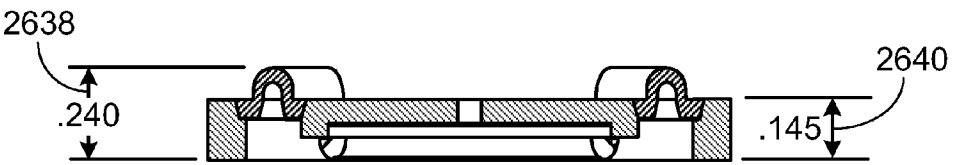

FIG. 26 shows a surround 2601 that is of different geometric dimensions than the surround 2501. The overall thickness 2640 of the surround assembly 2600 is 0.145 inches, thinner than the surround assembly 2500 which is 0.250 inches thick (See FIGS. 25C and 26C). The surround 2601 has four arc sections, 2606 and 2608, segregated by four ribs, 2610. The ribs 2610 of the surround 2601 are of different shape than the ribs 2510 of the surround 2501. As shown in FIG. 26B, the ribs 2610 have an oval shape, while the ribs 2501 have an I-beam configuration as shown in FIG. 25B.

The ribs 2610 have a height 2632 of 0.215 inches and a width 2631 of 0.260 inches as indicated in FIG. 26B. The flange sections 2634 of the ribs 2610 have a thickness 2636 of 0.040 inches. The height of the ribs 2610 is slightly less than the height 2638 of the surround assembly which is 0.240 inches.

Figure 27A:
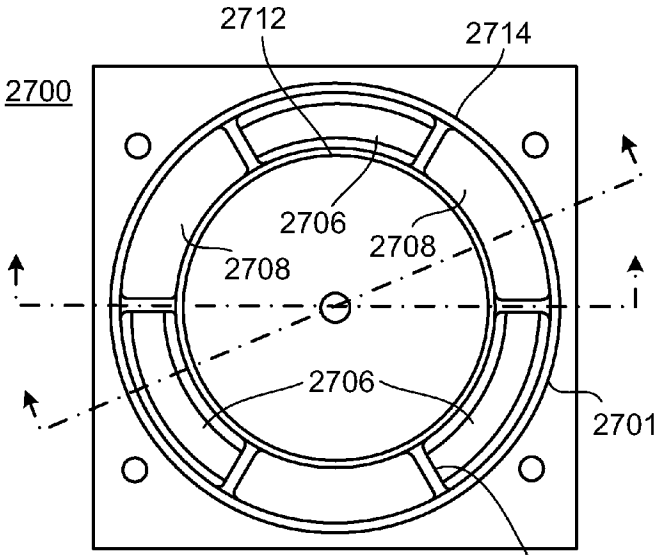
Figure 27C:
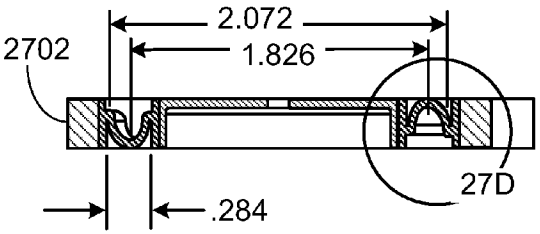
FIG. 27D is an enlarged side cross-sectional view of the diaphragm and surround assembly of FIG. 27C.
Figure 27D:
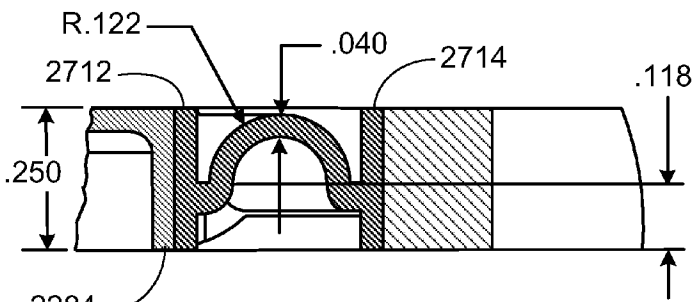
Figure 27B:
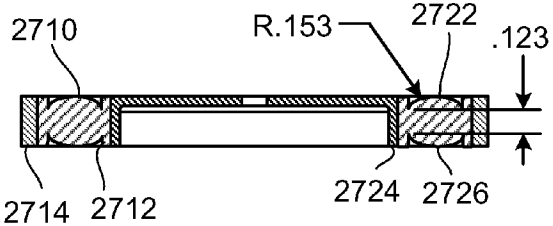

FIGS. 27A, 27B, 27 C, and 27 D show yet another embodiment of a surround assembly 2700. The surround assembly 2700 is similar to the surround assembly 2200 shown in FIG. 22A in that both the surrounds, 2201 and 2701, are divided into six arc sections by six ribs and that both the surround assemblies, 2200 and 2700, are of the same geometrical dimensions. The surround 2701 is also different from the surround 2201 in several other aspects.

First, the ribs of these two surrounds, 2201 and 2701, have different shapes. The ribs 2210 of the surround 2201 have an I-beam configuration. FIG. 27B shows that the ribs 2710 of the surrounds 2701 are a composition of two circular segments, 2722 and 2726, and one rectangular section, 2724, with the rectangular section 2724 in between the two circular segments, 2722 and 2726.

Second, the convex membranes 2706 and concave membranes 2708 do not have flange sections as the membranes 2206 and 2208 do.

Third, instead of having flange sections extending from the membranes, the surround 2701 has an inner wall 2712 and an outer wall 2714. Both the ribs 2710 and the membranes 2706 and 2708 are enclosed in between these two walls. Like the flange sections 2286 that can be used to connect the surround 2201 to the attachment frame 2202 and the diaphragm 2218, these two walls can be used to fit the surround 2701 into the surround assembly 2700 with the inner wall 2712 glued or the surround insert molded to the outer periphery of the diaphragm 2718 and the outer wall 2714 to the inner periphery of the attachment frame 2712.

FIGS. 22-25 present five different embodiments of surround assembly that can be used in passive radiators as well as acoustic drivers. They are designed to achieve superior sound qualities. The number of arc sections, the number of ribs, the shape of the ribs, the shape of the membranes, and the geometric dimensions are selected and arranged for that purpose.

A surround according to the invention provides good linear restoring axial forces and reduced rocking motion of the diaphragm. In referring to FIG. 21B, the axial restoring forces 24 as provided by the surround 21 are linear when the restoring forces 24 are proportional to the excursion E as the diaphragm 22 travels along the axis 27 away from the neutral position, plane 28. Both the membranes and the ribs contribute to the restoring forces 24.

Figure 28:
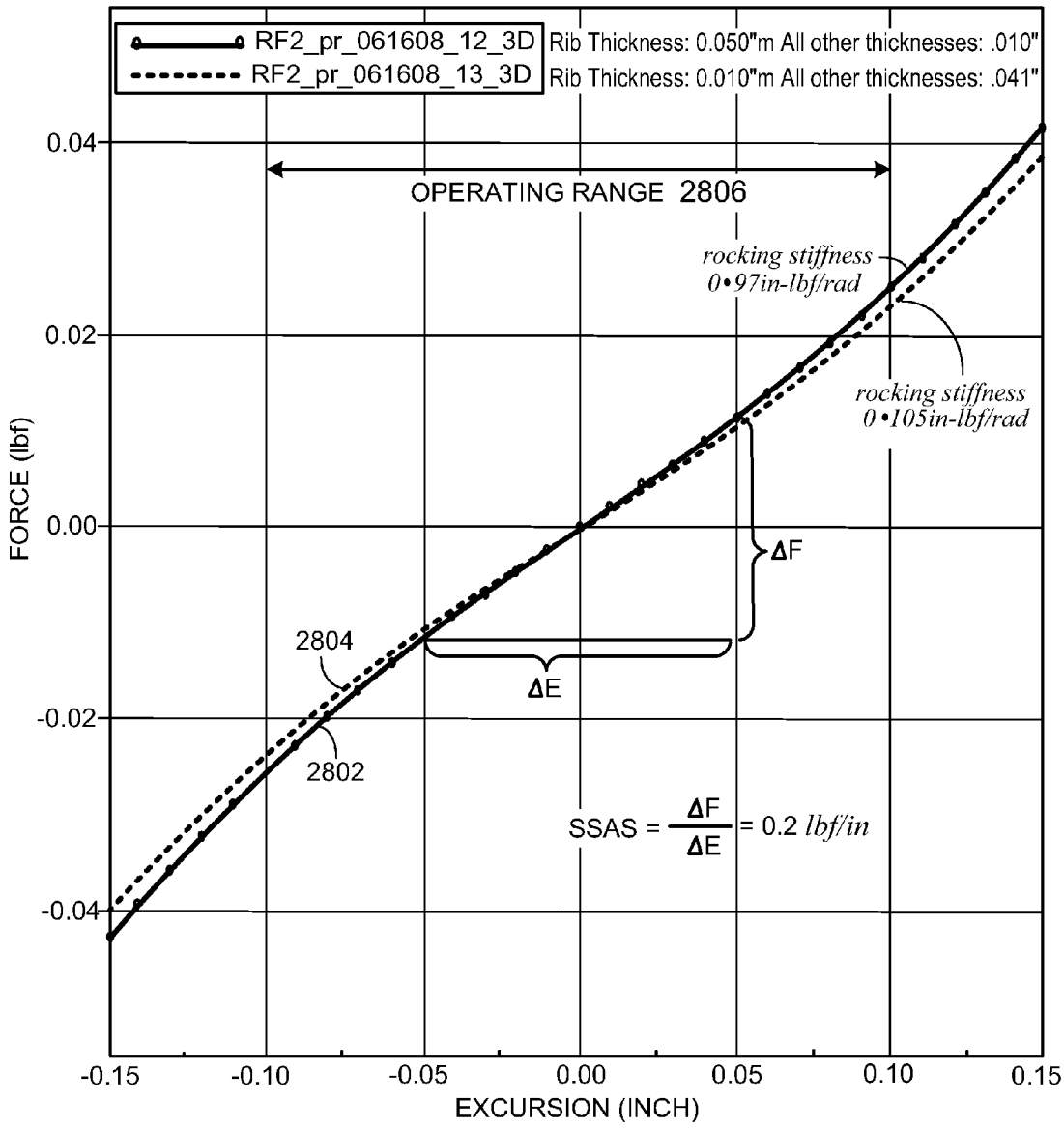
FIGS. 28, 29, and 30 show curves of restoring axial force as a function of excursion.
Figure 29:
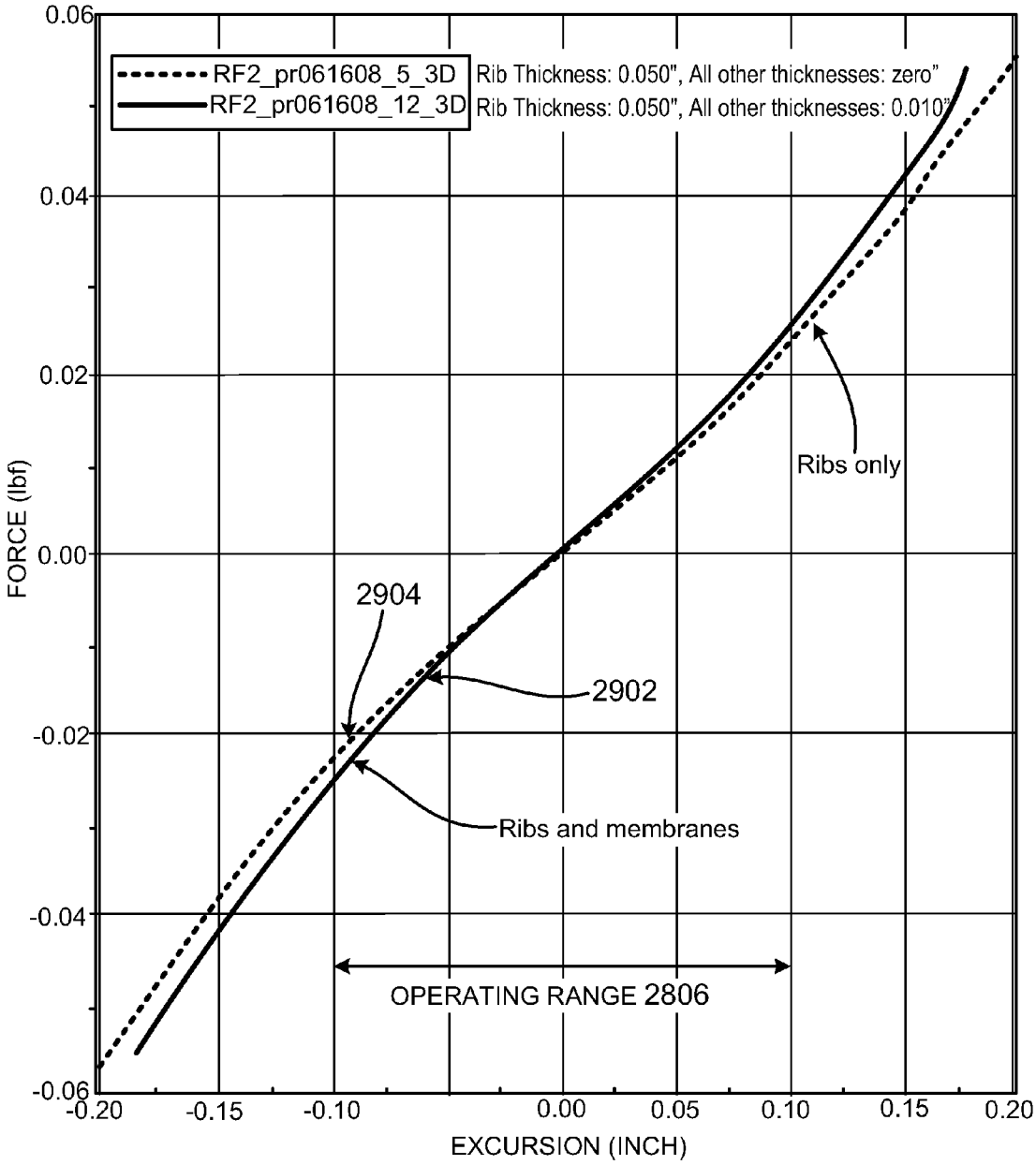
Figure 30:
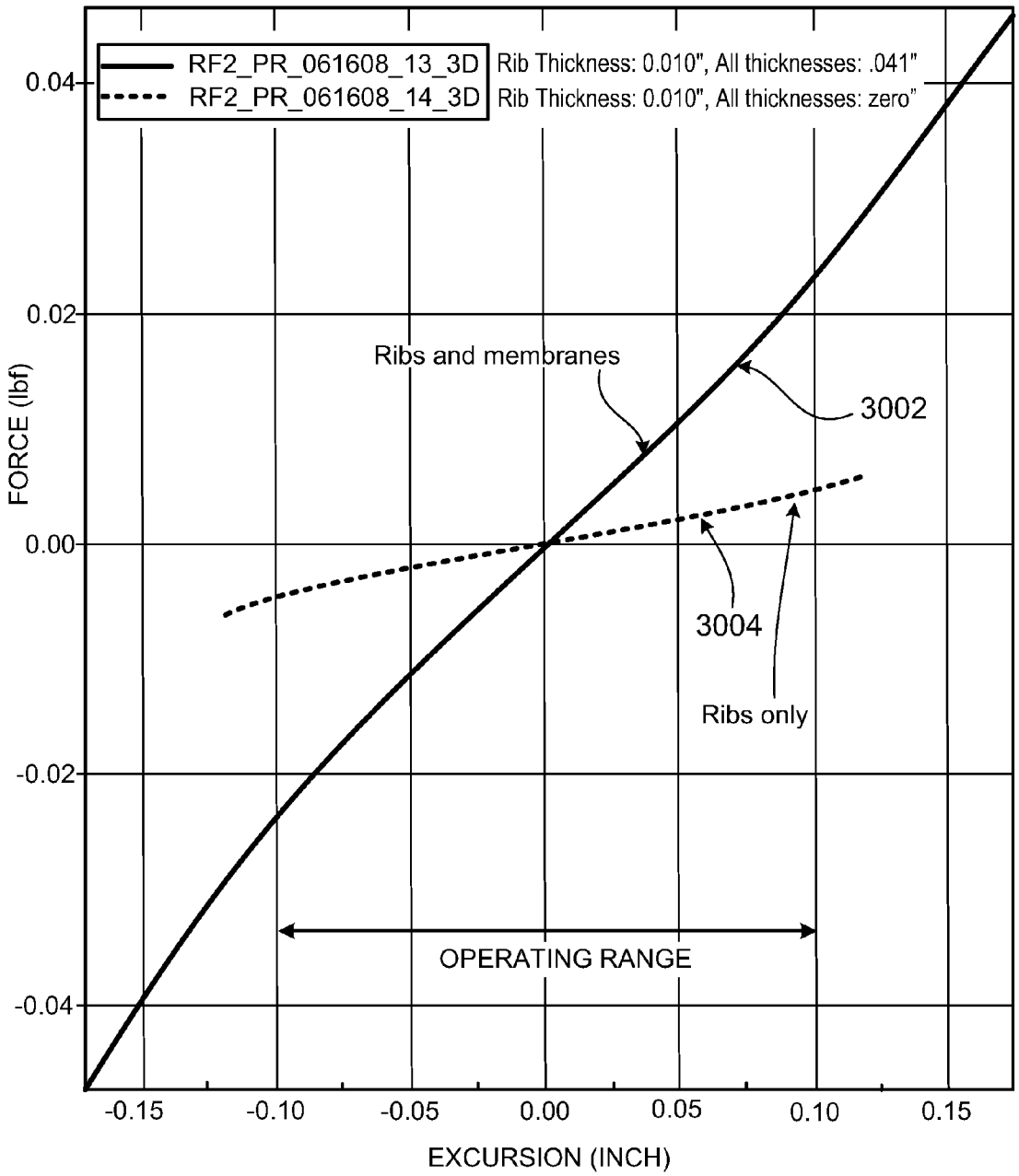

In FIGS. 28, 29, and 30, restoring forces are plotted as a function of excursion ΔE of the diaphragm for the surround assembly 2200, 2400, and 2500. As demonstrated in those figures, the restoring forces are linear when the excursion ΔE is small (ΔE<0.05 inches in either direction).

FIG. 28 shows the restoring forces for two models, RF2_pr__061608__12__3D and RF2_pr__061608__13__3D. The solid curve 2802 represents model RF2_pr__061608__12__3D and the dotted curve 2804 represents model RF2_pr__061608__13__3D. The two models differ in their geometric shapes and dimensions. In model RF2_pr__061608__12__3D, the rib thickness (2712 in FIG. 27A is 0.050 inches and all other thicknesses (2284 in FIG. 27D are 0.010 inches. In model RF2_pr__061608__13__3D, the rib thickness is 0.010 inches and all other thicknesses are 0.041 inches.

Though different in their geometric shapes and dimensions, these two models have the same small signal axial stiffness coefficient. As defined above, axial stiffness coefficient can be expressed as restoring force per unit excursion. Small signal axial stiffness coefficient of a model is the axial stiffness coefficient in the small signal range. In FIG. 28, axial stiffness coefficient of a surround model is the slope of the curve that represents the model. When the signals are small, the two curves coincide with each other. Thus, the two models have the same small signal axial stiffness coefficient (SSAS) which can be calculated using the following expression:

$$SSAS = \frac{\Delta F}{\Delta E} = \frac{0.02\ \text{lbf}}{0.1\ \text{in}} = 0.2\ \text{lbf/in}$$

As shown in FIG. 28, the restoring forces for both models are linear when the excursion of the diaphragm is small, i.e., the driving signals are small. The restoring forces stay linear with only slight deviation when the signals increase but are still within the operating range 2806 (ΔE<0.1 inches in either direction). Only outside the operating range 2806 does the deviation of the restoring force from linear become more significant.

Contribution to the axial stiffness coefficient of a surround comes from both the ribs and the membranes as illustrated in FIGS. 29 and 30. In FIG. 29, two curves 2902 and 2904 are plotted. The solid curve 2902 represents the combined contribution to the axial stiffness coefficient from the ribs and the membranes. The curve 2902 corresponds to a real surround model, model RF2_pr__061608__12__3D. On the other hand, the dotted curve 2904 represents the contribution to the axial stiffness coefficient from the ribs only and corresponds to a theoretical model in which the rib thickness is 0.050 inches and all other parts have a thickness of zero inch. The vertical difference between the curves 2902 and 2904 represents the contribution to the axial stiffness coefficient from the membranes only. In FIG. 29, throughout the entire range of the excursion, the curves 2902 and 2904 are close together, which means the contribution to the axial stiffness coefficient from the membranes remain small through out the entire range. In other words, in FIG. 29, the contribution to the axial stiffness coefficient from the ribs dominates both in the small and large signal ranges.

In FIG. 30, again two curves, 3002 and 3004, are plotted. The solid curve 3002 represents the contribution to the axial stiffness coefficient from the ribs and membranes, and is computed based on model RF2_pr__061608__13__3D. The dotted curve 3004 represents the contribution to the axial stiffness coefficient from the ribs only and is computed based on a theoretical model in which the rib thickness is 0.010 inches and the thickness of all other parts is zero.

In FIG. 30, throughout the entire range of the excursion, the curves 3002 and 3004 are farther apart than the two curves 2902 and 2904 in FIG. 29. As in FIG. 29, the vertical difference between the curves 3002 and 3004 represents the contribution to the axial stiffness coefficient from the membranes only. Different from FIG. 29, the vertical difference between the two curves 3002 and 3004 is larger than the contribution from the ribs as represented by the dotted curve, throughout the entire range of excursion. In other words, in FIG. 30, the contribution to the axial stiffness coefficient from the membranes dominate in both the small and large signal ranges.

Rocking stiffness coefficient is defined above as restoring torque per unit angle displacement. Rocking stiffness coefficient is related to axial stiffness coefficient, but also depends on many other factors, such as relative volumes of the ribs and membranes. Since the volumes of the ribs and membranes effect their contributions to the axial stiffness coefficient, rocking stiffness coefficient depends on the ratio of the contributions of the ribs and membranes to the axial stiffness coefficient.

For example, FIG. 28 shows that in the small signal range ($\Delta E<0.05$ inches), model RF2_pr_061608_12_3D and model RF2_pr_061608_13_3D have the same axial stiffness coefficient but different rocking stiffness coefficient. Model RF2_pr_061608_12_3D has a rocking stiffness coefficient of 0.097 in-lbf/rad and model RF2_pr_061608_13_3D has a rocking stiffness coefficient of 0.105 in-lbf/rad. This is because the ratios of the contributions to the axial stiffness coefficient are different for these two models, as shown in FIGS. 29 and 30. A ratio of the contributions to the axial stiffness coefficient from the membranes and the ribs at a certain excursion can be computed by dividing the contribution from the ribs (the vertical value of the dotted line) by the contribution from the membranes (the vertical difference between the dotted line and the solid line).

Furthermore, the rocking frequency of a surround is related to the rocking stiffness coefficient. The higher the rocking stiffness coefficient, the higher the rocking frequency. A good surround design preferably places the rocking frequency out of the band of the operating frequency or much higher than the frequency at which the surround has greatest axial excursion. The higher the rocking frequency, the less likely the rocking frequency will excite rocking modes. Because model RF2_pr_061608_13_3D has a higher rocking stiffness coefficient than model RF2_pr_061608_12_3D, the former has a higher rocking frequency.

Pushing the rocking frequency downwards so that it falls below the lower limit of the band of the operating frequency is also feasible.

Other examples are within the scope of the claims.

Figure 31C:
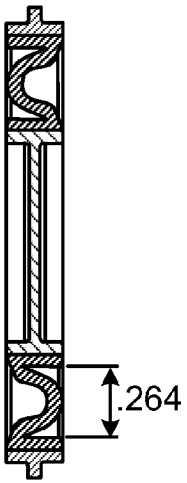
FIGS. 31A, 31B and 31C show plan, front sectional and end sectional views, respectively, of a surround of racetrack shape.
Figure 31A:
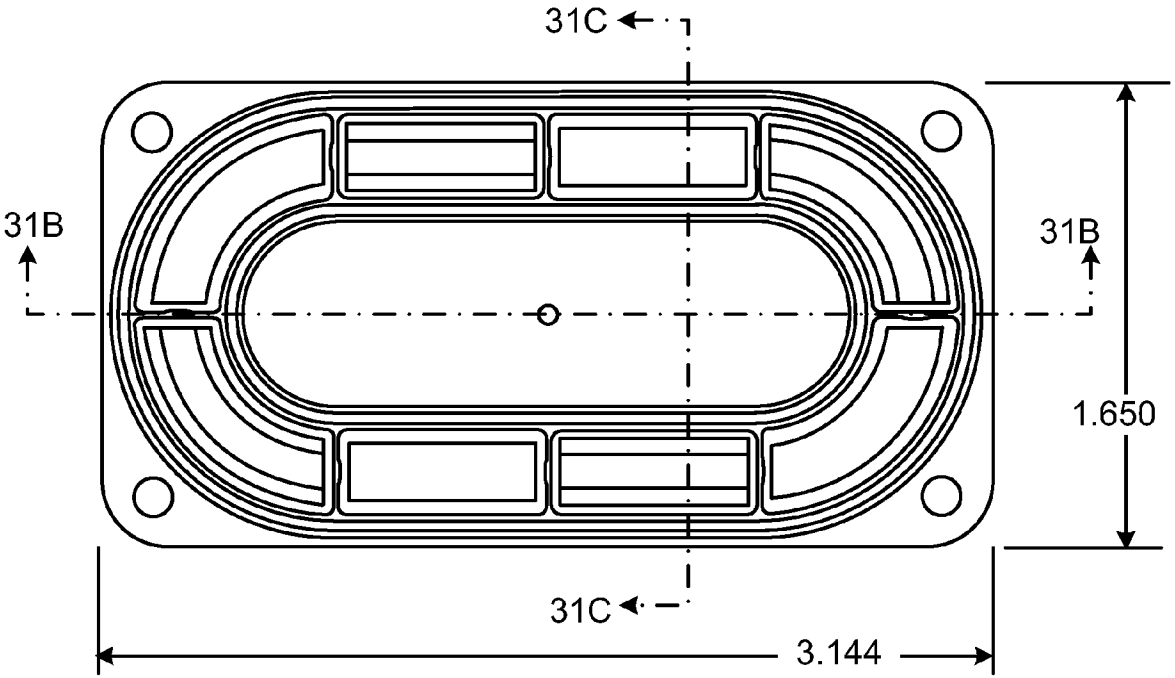
Figure 31B:
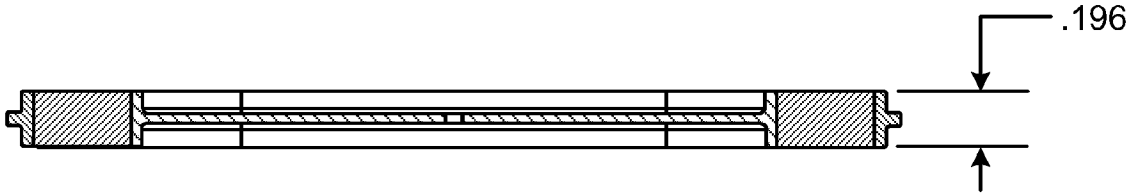

FIGS. 31A, 31B and 31C show plan, front sectional and end sectional views, respectively, of a surround of racetrack shape. For instance, while the examples described herein are generally circular in shape, surrounds can be square, rectangular, race-track, or other shapes. Additionally, there are many different ways of arranging the ribs and membranes of the surround in addition to the several that have been described herein.

It is evident that those skilled in the art may now make numerous departures from and modifications of the specific apparatus and techniques described herein without departing from the inventive concepts. Consequently, the invention is to be construed as embracing each and every novel feature and novel combination of features present in or possessed by the apparatus and techniques described herein and limited only by the spirit and scope of the appended claims.

What is claimed is:

1. A surround for a diaphragm, the surround comprising:

at least one rib section oriented to be extended during excursions of the diaphragm; and at least one membrane section that is supported by the one or more rib sections;

the one or more rib sections contributing to a compliance characteristic of the surround differently than the one or more membrane sections, the surround including an elastomer having an elongation at break above about 100%, the membrane section and the diaphragm being made of materials which differ from each other, wherein a top surface of the rib section is distinguishable from a top surface of the membrane section, and a bottom surface of the rib section is distinguishable from a bottom surface of the membrane section.

2. The surround of claim 1, in which at least one membrane section is different in thickness along the direction perpendicular to the surface of the diaphragm than are the one or more rib sections.

3. The apparatus of claim 1, in which the compliance characteristic comprises an axial stiffness.

4. The apparatus of claim 1, in which the compliance characteristic comprises a rocking stiffness.

5. The apparatus of claim 1, in which the one or more membranes sections have concave or convex shapes or both.

6. The apparatus of claim 1, in which the one or more rib sections each have an I-beam configuration in a cross-sectional view taken along a radial direction.

7. The apparatus of claim 1, in which the one or more rib sections each have a radial dimension that is larger than a circumferential dimension.

8. The apparatus of claim 1, in which the one or more rib sections each functions as a cap that seals a concave membrane section on one side and a convex membrane section on the other.

9. The apparatus of claim 1, in which the one or more membrane sections comprise at least two sections.

10. The apparatus of claim 5, in which the one or more membrane sections comprise at least one concave and at least one convex membrane sections.

11. The apparatus of claim 1, in which the one or more membrane sections comprise more than eight sections.

12. The apparatus of claim 1, in which the one or more membrane sections each have a half-roll structure.

13. The apparatus of claim 1, further including an outer flange which extends radially from the membrane section.

14. The apparatus of claim 1, further including an inner flange which extends radially from the membrane section.

15. The apparatus of claim 1, further including outer and inner flanges which both extend radially from the membrane section.

16. The apparatus of claim 1, further including an outer flange which extends in a direction that is perpendicular to a surface of the diaphragm.

17. The apparatus of claim 1, further including an inner flange which extends in a direction that is perpendicular to a surface of the diaphragm.

18. The apparatus of claim 1, further including outer and inner flanges which both extend in a direction that is perpendicular to a surface of the diaphragm.

19. The apparatus of claim 1, further including an inner flange, an outer flange and an attachment frame, wherein an outer periphery of the diaphragm is shaped to match the inner flange and an inner periphery of the attachment frame is shaped to match the outer flange, and the diaphragm, the apparatus, and the attachment frame can be assembled by gluing the inner flange onto the edge of the diaphragm and the outer flange onto the attachment frame, or by insert molding the surround with the diaphragm and attachment frame in place.

20. The apparatus of claim 5, in which the concave and convex membrane sections are arranged in a circumferentially symmetric manner to increase the rocking stiffness of the apparatus.

21. A surround for a diaphragm, the surround comprising:

first and second membrane sections, the first membrane section having a concave curved cross-section and the second membrane section having a convex curved cross-section; and at least one rib section that extends radially and is set in between the first and second membrane sections;

the concave and convex membrane sections that have the curved cross sections giving the surround a rocking stiffness and axial stiffness.

22. The apparatus of claim 21, in which the two membrane sections have one concave membrane section and one convex membrane section.

23. The apparatus of claim 1 in which the one or more rib sections each have an oval beam configuration in a cross-sectional view taken along a radial direction.

24. The apparatus of claim 1 in which the one or more rib sections each have a beam configuration defined by two circular segments joined by a rectangular segment in a cross-sectional view taken along a radial direction.

25. The apparatus of claim 1, in which the one or more rib sections contribute more or less to an axial stiffness than do the one or more membrane sections.

* * * * *